US012055042B2

(12) United States Patent
Blumhardt

(10) Patent No.: US 12,055,042 B2
(45) Date of Patent: Aug. 6, 2024

(54) SCREW EXPANDER WITH VARIABLE VOLUME CONTROLLED BY THE PRESSURE RATIO, AND PLANT FOR RECOVERING ELECTRICAL ENERGY FROM HEAT WITH A SCREW EXPANDER

(71) Applicant: BITZER Kuehlmaschinenbau GmbH, Sindelfingen (DE)

(72) Inventor: Marcus Blumhardt, Rutesheim (DE)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 0 days.

(21) Appl. No.: 17/341,035

(22) Filed: Jun. 7, 2021

(65) Prior Publication Data

US 2021/0388834 A1 Dec. 16, 2021

(30) Foreign Application Priority Data

Jun. 10, 2020 (DE) ..... 102020115442.9

(51) Int. Cl.
*F01C 1/16* (2006.01)
*F01C 20/12* (2006.01)

(52) U.S. Cl.
CPC ..... *F01C 1/16* (2013.01); *F01C 20/12* (2013.01); *F04C 2240/81* (2013.01)

(58) Field of Classification Search
CPC ..... F01C 20/12; F01C 1/16; F04C 2240/81
See application file for complete search history.

(56) References Cited

U.S. PATENT DOCUMENTS 3,656,876 A * 4/1972 Kocher ..... F01C 20/14 417/295
RE31,379 E * 9/1983 Shaw ..... F01C 20/125 417/310

(Continued)

FOREIGN PATENT DOCUMENTS

CH 386607 A 1/1965
DE 69228616 T2 12/1994

(Continued)

OTHER PUBLICATIONS

Machine translation and foreign document for CN-106801619-A, Published Jun. 2017, Inventor: Tang, Title: Screw Expander With Adjustable Volume. (Year: 2017).*

*Primary Examiner* — Mary Davis
(74) *Attorney, Agent, or Firm* — Reinhart Boerner Van Deuren P.C.

(57) ABSTRACT

In order to adapt to different operating conditions a screw expander, comprising an expander housing with a screw rotor chamber arranged therein, two screw rotors arranged in the screw rotor chamber and mounted rotatably in the expander housing, which screw rotors intermesh with their screw contours in order to receive working medium supplied by means of a high-pressure chamber arranged in the expander housing and in order to discharge said medium in the region of a low-pressure chamber arranged in the expander housing, and a generator driven by the screw rotors, it is proposed that the screw expander has at least one control slide, which is arranged in a slide channel of the expander housing and is adjacent to both screw rotors with slide wall surfaces, which control slide is movable in a displacement direction parallel to the screw rotor axes and is thereby configured to influence the final volume and/or the (Continued)

initial volume, and that a slide drive is provided for moving the control slide into different slide positions.

28 Claims, 16 Drawing Sheets

(56) References Cited

U.S. PATENT DOCUMENTS

| | | | | |
|---|---|---|---|---|
| 9,964,004 | B2 * | 5/2018 | Oxner | F01K 25/10 |
| 2005/0226758 | A1 | 10/2005 | Hossner | |
| 2014/0127067 | A1 | 5/2014 | Kienzle | |
| 2016/0319814 | A1 | 11/2016 | Mosemann et al. | |
| 2017/0211574 | A1 | 7/2017 | Loerch et al. | |
| 2020/0080559 | A1 | 3/2020 | Liu | |

FOREIGN PATENT DOCUMENTS

| | | | |
|---|---|---|---|
| DE | 10258145 | A1 | 6/2004 |
| DE | 102011121274 | A1 | 8/2012 |
| DE | 102011051730 | A1 | 1/2013 |
| DE | 102015116324 | A1 | 4/2016 |
| EP | 0630445 | B1 | 12/1994 |
| GB | 959831 | A | 6/1964 |
| WO | WO 2015/086159 | A1 | 12/2014 |

* cited by examiner

SCREW EXPANDER WITH VARIABLE VOLUME CONTROLLED BY THE PRESSURE RATIO, AND PLANT FOR RECOVERING ELECTRICAL ENERGY FROM HEAT WITH A SCREW EXPANDER

CROSS-REFERENCE TO RELATED PATENT APPLICATION

This patent application claims the benefit of German application No. 10 2020 115 442.9, filed Jun. 10, 2020, the teachings and disclosure of which are hereby incorporated in their entirety by reference thereto.

BACKGROUND OF THE INVENTION

The invention relates to a screw expander, comprising an expander housing with a screw rotor chamber arranged therein, two screw rotors arranged in the screw rotor chamber and each mounted in the expander housing so as to be rotatable about a screw rotor axis, which screw rotors intermesh with their screw contours and in each case cooperate with wall surfaces adjacent to the screw contours and partially surrounding the screw contours, in order to receive working medium, in particular gaseous working medium, supplied by means of a high-pressure chamber arranged in the expander housing and in order to discharge said medium in the region of a low-pressure chamber arranged in the expander housing, the in particular gaseous working medium being enclosed with an initial volume at high pressure in expansion chambers formed between the screw contours and wall surfaces adjacent to the screw contours and being expanded to a final volume at low pressure, and to a generator, in particular an electric generator, driven by the screw rotors.

The problem with such screw expanders is adapting the volume ratio defined by the initial volume and the final volume to different operating conditions.

SUMMARY OF THE INVENTION

In a screw expander of the type described at the outset, this object is achieved in accordance with the invention in that the screw expander has at least one control slide, which is arranged in a slide channel of the expander housing and is adjacent to both screw rotors with slide wall surfaces, which control slide is movable in a displacement direction parallel to the screw rotor axes and is thereby configured to influence the final volume and/or the initial volume, and in that a slide drive is provided for moving the control slide into different slide positions.

The advantage of the solution according to the invention can thus be seen to lie in the fact that the volume ratio of the screw expander can thus be adapted to different operating conditions during use of the screw expander, for example in a circulation of the working medium in a cyclic process.

In principle, a screw expander of this type operates with a control slide which is movable in a displacement direction and with which the various slide positions and thus different volume ratios are settable.

Alternatively, it is preferably provided that the screw expander has two control slides, a first control slide being configured to influence the initial volume and a second control slide being configured to influence the final volume.

An expander used in accordance with the invention is, for example, an open expander with an externally connected generator or a semi-hermetic expander with an integrated generator.

In addition, a control system is preferably provided which controls the slide drive for each control slide to set a volume ratio suitable for the expansion of the working medium, said volume ratio being formed from the final volume divided by initial volume.

The control system can operate according to different specifications.

One simple option provides that the control system detects the high pressure and the low pressure by means of sensors arranged one on the high-pressure side and one on the low-pressure side of a plant for expanding working medium or of an expander, for example said sensors being associated, respectively, with a high-pressure port on the expander side and a low-pressure port, and determines a pressure ratio of high pressure to low pressure from this.

Sufficient adaptations of the slide positions of the at least one control slide or of both control slides can be realized by means of the control system already at the time of determination of the pressure ratio of high pressure to low pressure.

The control system can operate according to different criteria.

A particularly simple solution provides that the control system positions the respective control slide by actuating the corresponding slide drive according to whether the pressure ratio of high pressure to low pressure exceeds or undershoots at least one specified limit value.

This means that, even with a specified limit value, it is possible to move the control slides into different slide positions by means of the control system.

In particular, it is provided that the control system moves the at least one control slide into a position with a reduced volume ratio of the final volume to the initial volume in the event that the pressure ratio undershoots the at least one limit value.

In addition, it is preferably provided that, when the at least one limit value is exceeded, the control system moves the at least one control slide into a position with a larger volume ratio of the final volume to the initial volume.

In the simplest case, one slide position corresponds here to a larger, for example maximum, volume ratio and another slide position corresponds to a smaller, for example reduced, in particular a minimum, volume ratio, with the slide position for the larger volume ratio being used for pressure ratio values that are above the specified limit value and the slide position for the smaller volume ratio or even the minimum ratio being used for pressure ratio values that are below the limit value.

However, it is even more advantageous if the control system positions the control slide according to the exceeding or undershooting of several limit values for the pressure ratio.

In this case, it is possible to define a first limit value for the pressure ratio, above which the slide position for the maximum volume ratio is set, and below which slide positions for reduced volume ratios are set, it being possible to still also differentiate between different reduced volume ratios by means of further limit values for the pressure ratio, so that, for example, with at least one further limit value for the pressure ratio, differentiation is still possible between a slide position for a higher reduced volume ratio as opposed to a slide position for the lowest reduced volume ratio.

With regard to the further function of the control system, a wide variety of possibilities are conceivable.

For example, a simple solution provides that the control system moves the respective control slide into slide positions corresponding to predefined volume ratios.

This can be two different predefined slide positions or several predefined slide positions.

With this solution, predefined, i.e. specified, slide positions are thus assumed and are then held by the control system in cooperation with the respective slide drive.

Alternatively, the control system can move the respective control slide in a position-controlled manner, i.e., into any slide positions that are realizable by the screw expander, so that optimal utilization of the expansion possibilities of the screw expander is ensured within the scope of its constructional possibilities.

In particular, within the scope of the solution according to the invention, it is provided that the control system determines the positions of the control slides taking into account at least one or more of the parameters, such as pressure level at low pressure, pressure level at high pressure, temperature of the gaseous medium at high pressure and low pressure, speed of the screw rotors, power consumption parameters of the gaseous working medium, in particular of the refrigerant, and use limit values of the screw expander.

Furthermore, in the solution according to the invention, a position detection unit is preferably provided for the at least one control slide.

For example, the position detection unit comprises a position indicator element coupled to the positions of the at least one control slide, and the at least one position indicator element cooperates with a detector element, the detector element being coupled to an evaluation unit that detects the positions of the position indicator element.

In the simplest case, it is provided that the at least one position indicator element is movable parallel to the displacement direction of the at least one control slide together with the latter, in particular is rigidly coupled to the control slide.

In the case of two control slides, it is preferably provided that the position detection unit for the two control slides comprises a first position indicator element coupled to the first control slide and a second position indicator element coupled to the second control slide, and that both position indicator elements cooperate with a common detector element.

In this case, the common detector element with the evaluation unit is able to detect the positions of both position indicator elements.

An advantageous solution provides that the detector element extends parallel to the displacement direction of the at least one control slide along which the position indicator element is movable.

Especially in the case of two control slides, it is provided that the detector element extends parallel to the displacement direction of the first and second control slides and along which the position indicator elements are movable when the control slides are moved.

No further details have yet been provided regarding the arrangement of the position detection unit.

For example, an advantageous solution provides that the position detection unit is arranged in a detector channel running inside the expander housing parallel to the displacement direction.

Furthermore, it is also provided that the respective position indicator element is arranged in the detector channel.

A particularly favorable solution provides that the respective position indicator element cooperates with the detector element without contact.

To detect the position of the at least one control slide, it is also conceivable, for example, if the control slide is driven by a spindle drive with an electric motor, to detect the rotational positions and/or revolutions of the electric motor during the positioning of the control slide and to determine the position of the control slide from these.

No further details have yet been provided with regard to the construction of the screw expander, in particular in the case of two control slides.

For example, it is preferably provided that the first control slide and the second control slide are arranged one behind the other in the displacement direction thereof.

Furthermore, it is expedient that the first control slide and the second control slide have an identical outer contour.

In addition, it is advantageously provided that the first control slide and the second control slide are positionable directly adjoining each other in a combined disposition and are movable together in the displacement direction.

It is further provided that the first and second control slides are positionable in a separated disposition at a spacing from each other, forming an intermediate space.

With regard to the configuration of the slide drive for the control slide, no further details have been provided in conjunction with the previous explanations.

For example, it is preferably provided that the first control slide is rigidly connected to a piston of a cylinder arrangement forming the first slide drive for moving the control slide.

Further, an advantageous solution provides that the second control slide is rigidly coupled to a piston of a cylinder arrangement forming the second slide drive for moving the second control slide.

As an alternative to providing cylinder arrangements as a slide drive, another advantageous solution provides a spindle drive driven by a motor, in particular an electric motor, as a slide drive.

It is expedient to supply the electric motor, for example, by means of the generator provided for generating the electrical energy or by means of an auxiliary generator coupled to one of the screw rotors.

However, it is also conceivable to feed the electric motor from the mains into which the energy generated by the electric generator is coupled.

Furthermore, the invention relates to a plant for recovering electrical energy from heat, comprising a cyclic process in which a working medium guided in a circuit is compressed starting from the condensed state, evaporated by the supply of heat, expanded in an expansion unit and subsequently condensed by the removal of heat, the expansion unit having at least one screw expander according to one of the preceding features for the expansion of the working medium.

The foregoing description of solutions according to the invention thus includes, in particular, the various combinations of features defined by the following consecutively numbered embodiments:

1. A screw expander (10) comprising an expander housing (12) with a screw rotor chamber (18) arranged therein, two screw rotors (26, 28) which are arranged in the screw rotor chamber (18) and are each mounted in the expander housing (12) so as to be rotatable about a screw rotor axis (22, 24), which screw rotors intermesh with their screw contours (32, 34) and each cooperate with wall surfaces (36, 38) adjacent to the screw contours and partially surrounding the screw contours, in order to receive working medium supplied by means of a high-pressure chamber (44) arranged in the expander housing (12) and to discharge it in the region of a low-pressure chamber (42) arranged in the expander housing (12), the gaseous working medium being enclosed with an initial volume at high pressure (PH) in expansion chambers formed between the screw contours (32, 34) and wall surfaces (36, 38) adjacent thereto and being expanded to a final volume at low pressure (PN), and a generator (30) driven by the screw rotors (52, 54), the screw expander (10) having at least one control slide (52, 52', 54) arranged in a slide channel (56) of the expander housing (12) and adjacent to both screw rotors (26, 28) with slide wall surfaces (62, 64), which at least one control slide is movable in a displacement direction (72) parallel to the screw rotor axes (22, 24) and is thereby configured to influence the final volume and/or the initial volume, and a slide drive (112, 132, 113) being provided for moving the control slide (52, 52', 54) into different slide positions.

2. A screw expander according to embodiment 1, wherein the screw expander (10) has two control slides (52, 54), wherein a first control slide (52) is configured to influence the initial volume and a second control slide (54) is configured to influence the final volume.

3. A screw expander according to embodiment 1 or 2, wherein a control system (218) is provided which controls the slide drive (112, 132) for the respective control slide (52, 52', 54) to set a volume ratio ($V_i$) suitable for the expansion of the working medium, said volume ratio being formed from final volume divided by initial volume.

4. A screw expander according to embodiment 3, wherein the control system (218) detects the high pressure (PH) and the low pressure (PN) by means of sensors (SPH, SPN) arranged one on the high-pressure side and one on the low-pressure side and determines a pressure ratio (PV) of high pressure (PH) to low pressure (PN) from this.

5. A screw expander according to embodiment 3 or 4, wherein the control system (218) positions the respective control slide (52, 52', 54) by actuating the respective slide drive (112, 132, 113) according to whether the pressure ratio (PV) of high pressure (PH) to low pressure (PN) exceeds or undershoots at least one specified limit value (G).

6. A screw expander according to embodiment 5, wherein the control system (218) moves the at least one control slide (52, 52', 54) into a position with a smaller volume ratio ($V_i$) of the final volume to the initial volume when the at least one limit value ($G_1$) is undershot.

7. A screw expander according to embodiment 5 or 6, wherein the control system (218) moves the at least one control slide (52, 52', 54) into a position with a larger volume ratio ($V_i$ ) of the final volume to the initial volume when the at least one limit value ($G_1$) is exceeded.

8. A screw expander according to one of embodiments 5 to 7, wherein the control system (218) positions the control slide (52, 52', 54) in accordance with exceeding or undershooting a plurality of limit values ($G_1$, $G_w$) for the pressure ratio (PV).

9. A screw expander according to one of the preceding embodiments, wherein the control system (218) moves the respective control slide (52, 52', 54) into slide positions corresponding to predefined volume ratios ($V_i$).

10. A screw expander according to one of the preceding embodiments, wherein the control system (218) positions the respective control slide (52, 52', 54) in a position-controlled manner.

11. A screw expander according to one of embodiments 3 to 10, wherein the control system (218) determines the positions of the control slides (52, 52', 54) taking into account at least one or more of the parameters, such as pressure level (PN) at low pressure, pressure level (PH) at high pressure, temperature of the gaseous working medium at high pressure and low pressure (PN), speed of the screw rotors (26, 28), power consumption of a generator (30), parameters of the gaseous working medium, in particular the refrigerant, and use limit values of the screw expander (12).

12. A screw expander according to one of the preceding embodiments, wherein a position detection unit (152, 152', 152") is provided for the at least one control slide (52, 52', 54).

13. A screw expander according to embodiment 12, wherein the position detection unit (152) has a position indicator element (156, 156', 156", 158) coupled to the position of the at least one control slide (52, 52', 54), the at least one position indicator element (156, 156', 156", 158) cooperates with a detector element (154), and the detector element (154) is coupled to an evaluation unit (192, 192', 192") which detects the positions of the position indicator element (156, 156', 156", 158).

14. A screw expander according to embodiment 12 or 13, wherein the at least one position indicator element (156, 156', 158) is movable parallel to the displacement direction (72) of the at least one control slide (52, 52', 54) together therewith.

15. A screw expander according to one of embodiments 12 to 14, wherein a position detection unit (152) for the two control slides (52, 54) is provided, which comprises a first position indicator element (156) coupled to the first control slide (52) and a second position indicator element (158) coupled to the second control slide (54), and both position indicator elements (156, 158) cooperate with a common detector element (154).

16. A screw expander according to one of embodiments 12 to 15, wherein the detector element (154) extends parallel to the displacement direction (72) of the at least one control slide (52, 54) along which the position indicator element (156, 158) is movable.

17. A screw expander according to embodiment 15 or 16, wherein the detector element (154) extends parallel to the displacement direction (72) of the first and second control slides (52, 54) and along which the position indicator elements (156, 156', 158) are movable when the control slides (52, 52', 54) are moved.

18. A screw expander according to one of embodiments 12 to 17, wherein the position detection unit (152, 152') is arranged in a detector channel (216) running within the expander housing (12) parallel to the displacement direction (72).

19. A screw expander according to one of embodiments 12 to 18, wherein the respective position indicator element (156, 156', 158) is arranged in the detector channel (216).

20. A screw expander according to one of the preceding embodiments, wherein the respective position indicator element (156, 156', 156", 158) cooperates with the detector element (154) in a contactless manner.

21. A screw expander according to one of the preceding embodiments, wherein the first control slide (52) and the second control slide (54) are arranged one behind the other in the displacement direction (72) thereof.

22. A screw expander according to embodiment 21, wherein the first control slide (52) and the second control slide (54) have an identical outer contour.

23. A screw expander according to embodiment 21 or 22, wherein the first control slide (52) and the second control slide (54) are positionable in a combined disposition directly adjoining one another and are movable together in the displacement direction (72).

24. A screw expander according to one of embodiments 21 to 23, wherein the first and second control slides (52, 54) are positionable in a separated disposition at a spacing from each other, forming an intermediate space.

25. A screw expander according to one of the preceding embodiments, wherein the first control slide (52) is rigidly connected to a piston (118) of a cylinder arrangement (112) forming the first slide drive for moving the first control slide (52).

26. A screw expander according to one of the preceding embodiments, wherein the second control slide (54) is rigidly coupled to a piston (136) of a cylinder arrangement (132) forming the second slide drive for movement of the second control slide (54).

27. A screw expander according to one of embodiments 1 to 24, wherein the at least one control slide (52') is driven by means of a spindle drive (113).

28. A screw expander according to embodiment 27, wherein the spindle drive (113) is driven by an electric drive motor (115).

29. A plant for recovering electrical energy from heat, comprising a cyclic process in which a working medium guided in a circuit (240) is compressed starting from the condensed state, evaporated by the supply of heat, expanded in an expansion unit (260) and subsequently condensed by the removal of heat, the expansion unit (260) having at least one screw expander (10) according to one of the preceding embodiments for the expansion of the working medium.

Further features and advantages of the invention are the subject of the following description as well as the graphical representation of some embodiment examples.

DETAILED DESCRIPTION OF THE INVENTION

Figure 1:
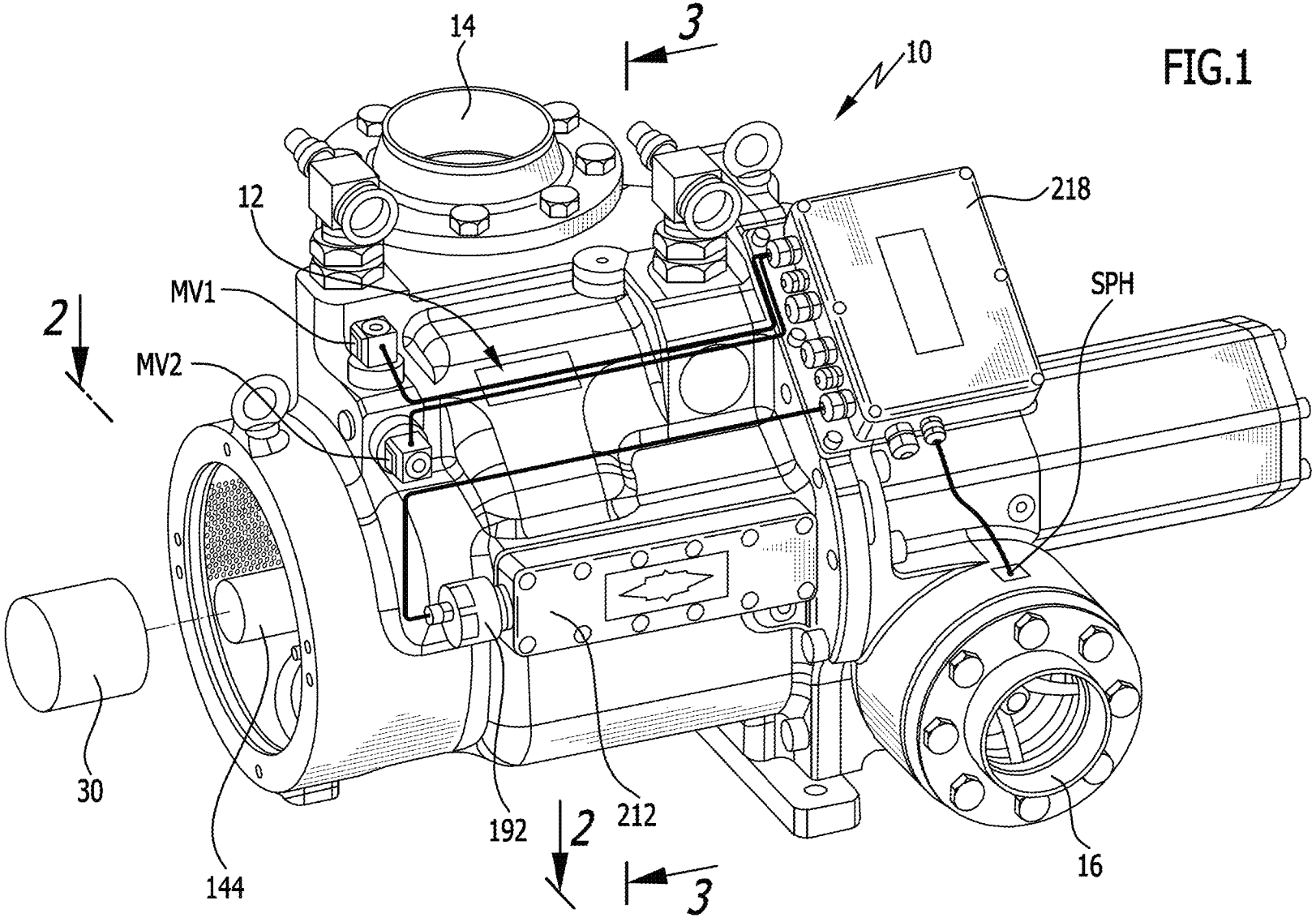
FIG. 1 shows a perspective view of a first embodiment example of a screw expander according to the invention.

An embodiment example of a screw expander 10 according to the invention shown in FIG. 1 comprises an expander housing denoted as a whole by 12, which has an outlet port 14, by means of which an expanded gaseous medium, in particular refrigerant, exits, and an inlet port 16, by means of which gaseous medium under high pressure, in particular the refrigerant, enters.

Figure 2:
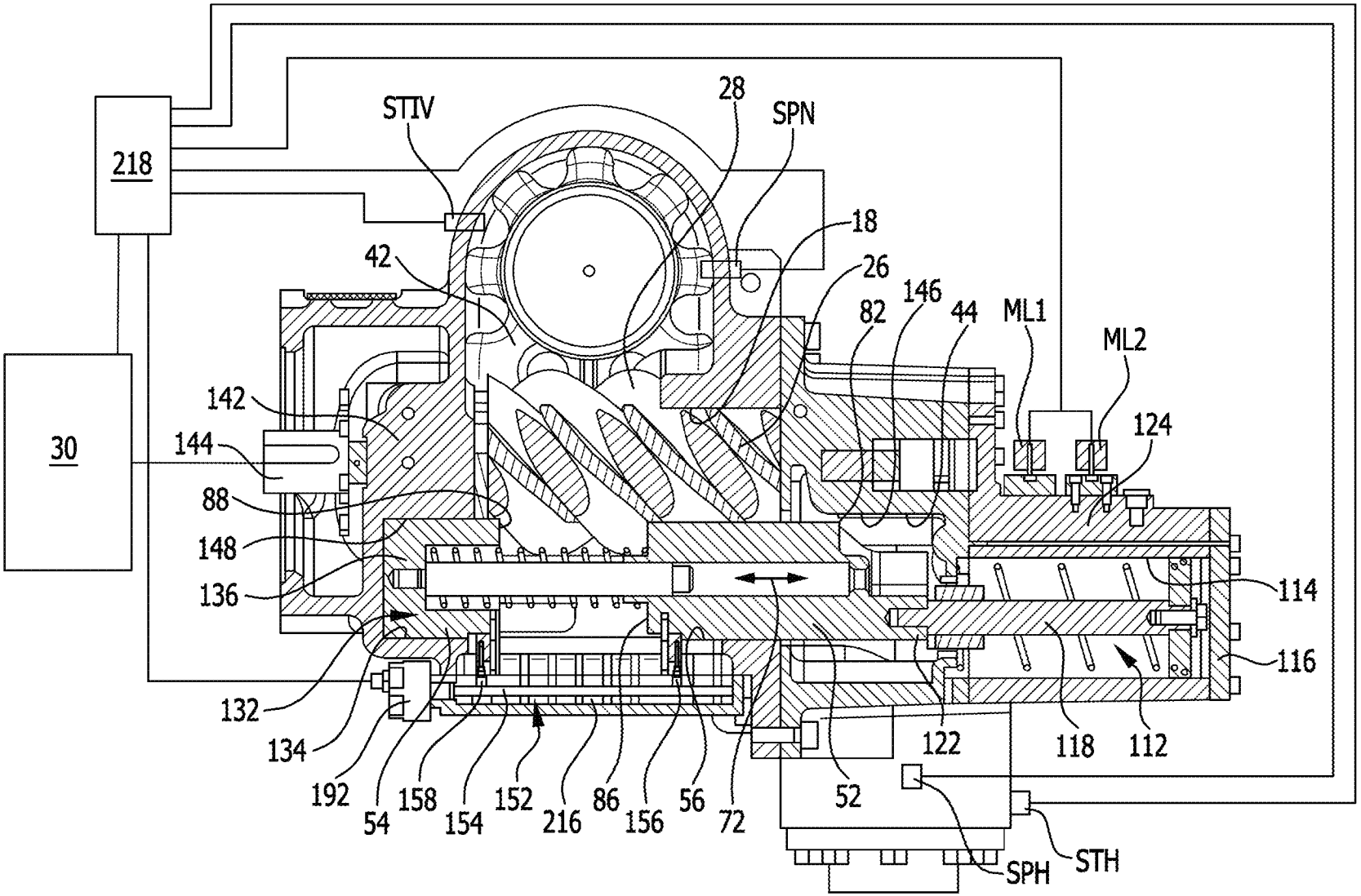
FIG. 2 shows a section along line 2-2 in FIG. 1.
Figure 3:
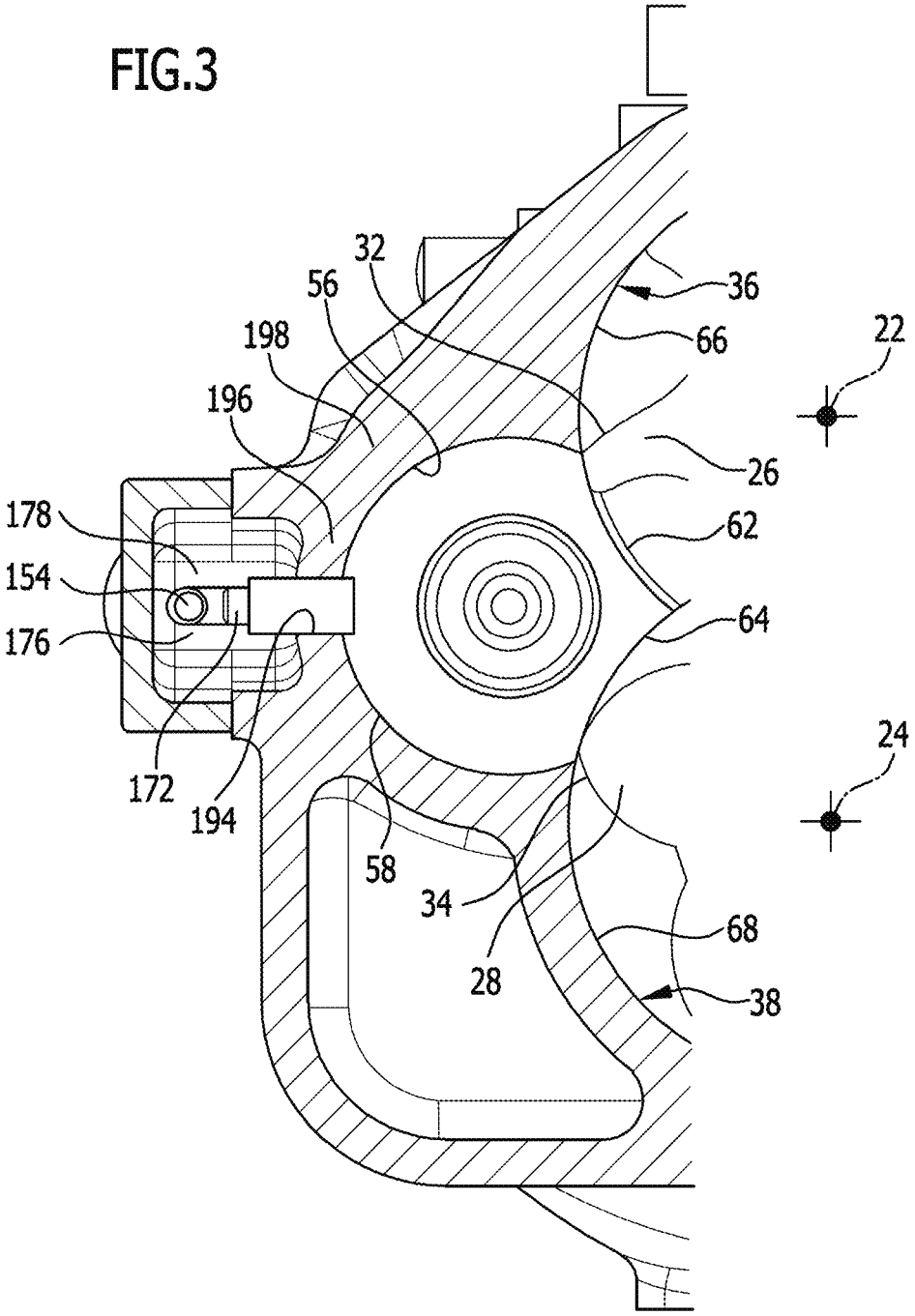
FIG. 3 shows a section along line 3-3 in the region of a position detection unit.

As shown in FIGS. 2 and 3, two screw rotors 26, 28, each rotatable about a screw rotor axis 22, 24 and coupled to a generator 30, are provided in a screw rotor chamber 18 of the expander housing 12, which screw rotors intermesh with their screw contours 32 and 34 and cooperate with wall surfaces 36 and 38 of the screw rotor chamber 18 adjacent to the circumference of the screw rotors, in order to receive gaseous medium supplied in a high-pressure chamber 44 adjacent to the screw contours 32, 34, expand it, and discharge it at low pressure into a low-pressure chamber 42 in the expander housing 12.

In this process, the gaseous medium, in particular refrigerant, is enclosed at high pressure in an initial volume in expansion chambers formed between the screw contours 32, 34 and the wall surfaces 36, 38 adjacent to them and expanded to a final volume at low pressure.

In order to adapt the screw expander 10, for example, to the operating conditions required in an expansion circuit, the operating state of the screw expander 10 is adapted, on the one hand, with regard to the volume ratio, which indicates the relation between the maximum enclosed initial volume and the discharged final volume, and, on the other hand, with regard to the expander power, which indicates the proportion of the volume flow actually expanded by the screw expander relative to the maximum volume flow expandable by the screw expander 10.

To adapt the operating state, in a first embodiment example shown in FIGS. 2 to 8, a first control slide 52 and a second control slide 54 are arranged one behind the other in a slide channel 56 provided in the expander housing 12, the slide channel 56 running parallel to the screw rotor axes 22, 24 and guiding the first control slide 52 and the second control slide 54 in the region of their guide peripheral surface 58 not adjacent to the screw rotors 26, 28.

The first control slide 52 faces the high-pressure chamber 44 and is thus arranged on the high pressure side, and the second control slide 54 is arranged on the low pressure side relative to the first control slide 52.

Each of the two control slides 52 and 54 further has a slide wall surface 62 adjacent to the screw rotor 26 and a slide wall surface 64 adjacent to the screw rotor 28, which slide wall surfaces are partial surfaces of the wall surfaces 36 and 38, and housing wall surfaces 66 and 68 formed by the expander housing 12, which housing wall surfaces are also partial surfaces of the wall surfaces 36 and 38, and complement the housing wall surfaces to form the wall surfaces 36 and 38, which together with the screw contours 32 and 34 contribute to the formation of the expansion chambers.

As shown in FIGS. 2 and 4 to 8, the first control slide 52 and the second control slide 54 are formed to be identical to the extent that they form the slide wall surfaces 62 and 64 and the guide peripheral surface 58, and thus they can be slidably guided in the slide channel 56 of the expander housing 12 in a displacement direction 72 running parallel to the screw rotor axes 22, 24.

In this case, the first control slide 52 forms an inlet edge 82 facing the high-pressure chamber 44 and defining the initial volume of the expansion chambers, which inlet edge can be displaced in the displacement direction 72 by displacing the first control slide 52 and, by its position relative to a high-pressure-side termination face 84 of the screw rotor chamber 18, also determines the initial volume of the expansion chambers formed and thus the volume ratio.

Figure 4:
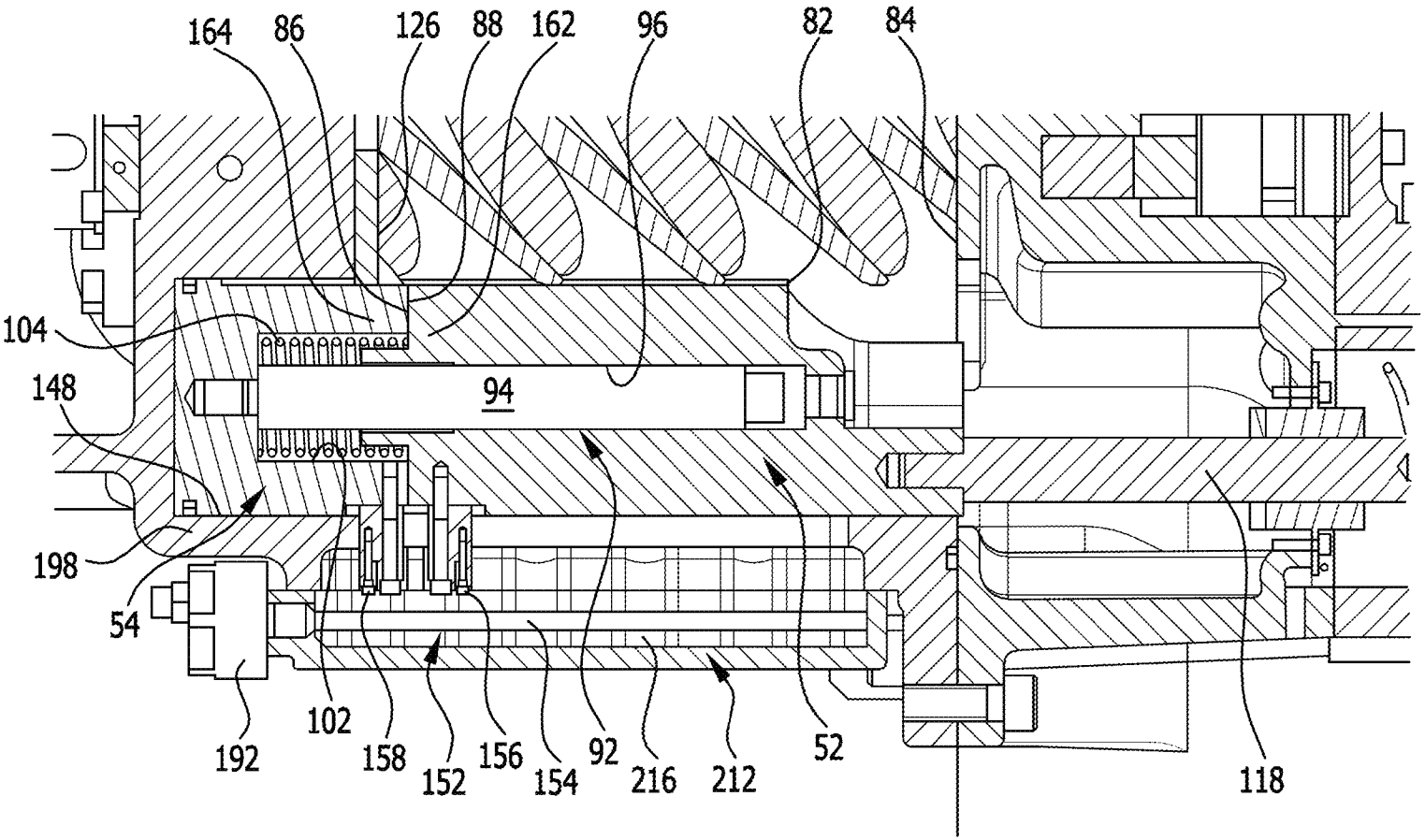
FIG. 4 shows an enlarged section similar to FIG. 2 in the region of the position detection unit and the control slides at maximum power and smallest volume ratio.
Figure 5:
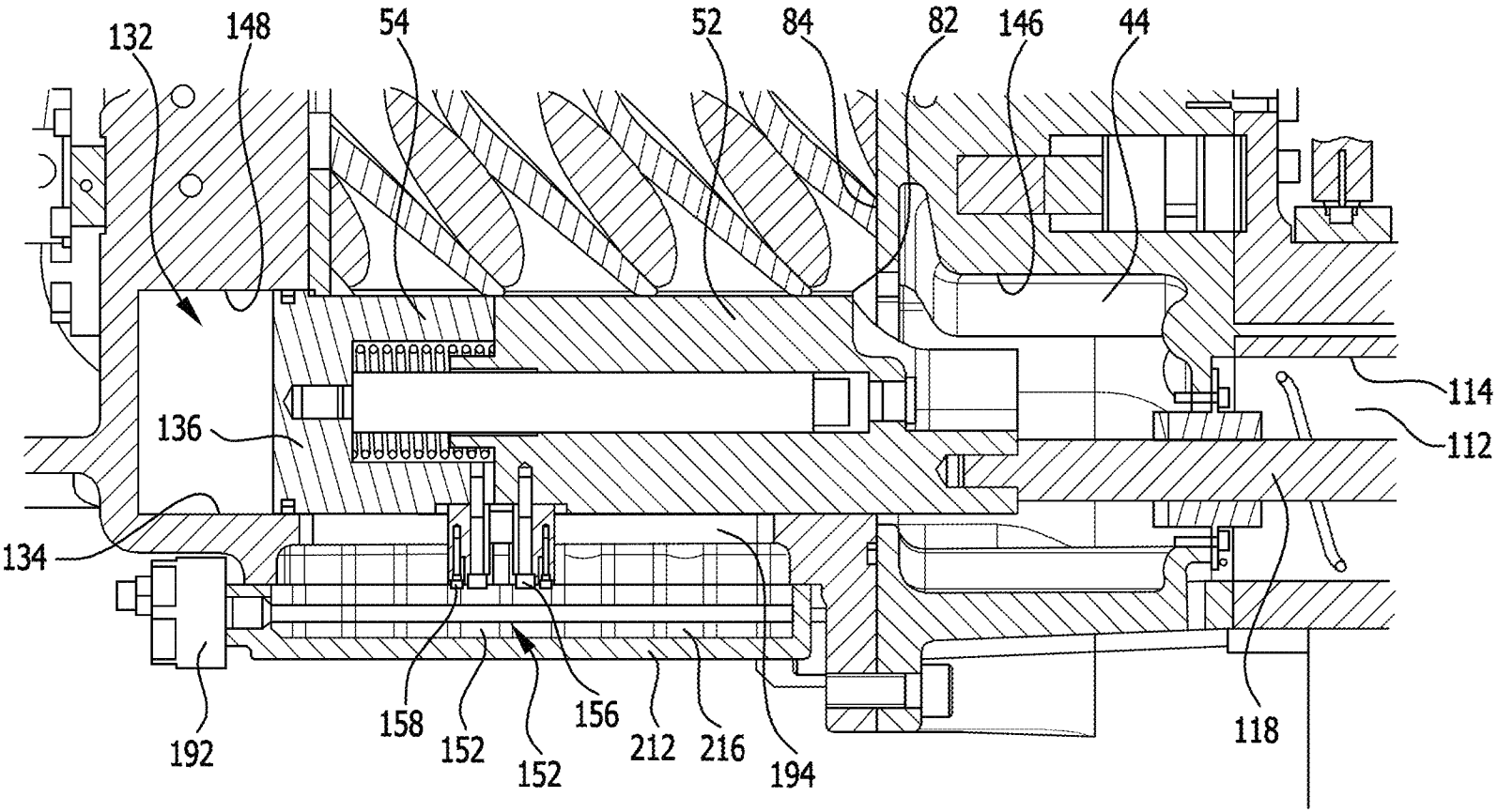
FIG. 5 shows a representation similar to FIG. 4 at maximum delivery volume and largest volume ratio.

As shown in FIGS. 2 and 4 to 8, the first control slide 52 and the second control slide 54 have end faces 86 and 88 facing one another, by means which said control slides are abuttable against each other, as shown for example in FIG. 4 and FIG. 5, so that the slide wall surfaces 62 and 64 of the first control slide 52 and of the second control slide 54 merge into each other.

Further, the first control slide 52 and the second control slide 54 are guided relative to each other, in addition to the slide channel 56, by a telescopic guide 92 having an inner guide body 94 and a guide receptacle 96, the guide receptacle 96 being provided in the first control slide 52 and the guide body 94 being retained on the second control slide 54 and projecting beyond the end face 88 thereof so that it can engage in the guide receptacle 96 in the first control slide 52.

Furthermore, a compression spring 104 is preferably also provided in an interior 102 of the second control slide 54 surrounding the guide body 94, which compression spring 104 serves to act on the first control slide 52 relative to the second control slide 54 in such a way that the end faces 86 and 88 are movable away from one another.

For displacing the first control slide 52, as shown in FIG. 2, a cylinder arrangement 112 is provided as a first slide drive, comprising a cylinder chamber 114 and a piston 116, wherein the piston 116 is connected to a piston rod 118, which establishes a connection to the first control slide 52, for example to an extension 122 of the first control slide 52, which is arranged, for example, on a side thereof opposite the end face 86.

Furthermore, the cylinder arrangement 112 is located in particular on a side of the first control slide 52 opposite the second control slide 54, preferably in a high-pressure-side housing portion 124 of the expander housing 12, which is arranged downstream of the slide channel 56 and downstream of the high-pressure chamber 44 and thus on a side of the expander housing 12 opposite the low-pressure chamber 42.

The second control slide 54 is displaceable by a cylinder arrangement 132 forming a second slide drive, which cylinder arrangement comprises a piston 136 movable in a cylinder chamber 134, the cylinder chamber 134 extending in particular in continuation of the slide channel 56 in a low-pressure-side housing portion 142, in which drive-side bearing units for the screw rotors 26 and 28 are arranged, which can be driven, for example, by means of an output shaft 144.

In particular, the piston 136 is integrally molded on the second control slide 54 and has a piston area at least equal to the cross-sectional area of the second control slide 54.

The low-pressure-side housing portion 142, which receives the cylinder chamber 134 for the cylinder arrangement 132 for moving the second control slide 54, is arranged in a region of the expander housing 12 opposite the high-pressure-side housing portion 124 for receiving the cylinder chamber 114 for the cylinder arrangement 112.

The cylinder arrangements 112 and 132 are operable, for example, by means of pressurized oil which is present in the expander in any case for lubricating the screw rotors 26, 28.

Furthermore, different piston settings can also be set in such cylinder arrangements, as described for example in EP 1 072 796 A1, to which reference is hereby made.

The first control slide 52 and the second control slide 54 can be pushed together by the cylinder arrangements 112 and 132 to such an extent that the end faces 86 and 88 abut one another in a combined disposition, and the two control slides 52, 54 can also be moved together in the combined disposition as a single control slide, which extends from the low-pressure-side termination face 126 in the direction of the high-pressure-side termination face 84 and the inlet edge 82 of which helps to define the volume ratio, wherein, as shown in FIG. 4, the screw expander 10 always delivers the maximum volume flow in this combined disposition.

Depending on the position of the inlet edge 82 relative to the termination face 84, the volume ratio can be adjusted, increasing as the spacing of the inlet edge 82 from the termination face 84 becomes progressively smaller and reaching its maximum value when the inlet edge 82 is at the shortest spacing from the termination face 84 required to minimize the initial volume, as shown for example in FIG. 5.

Figure 6:
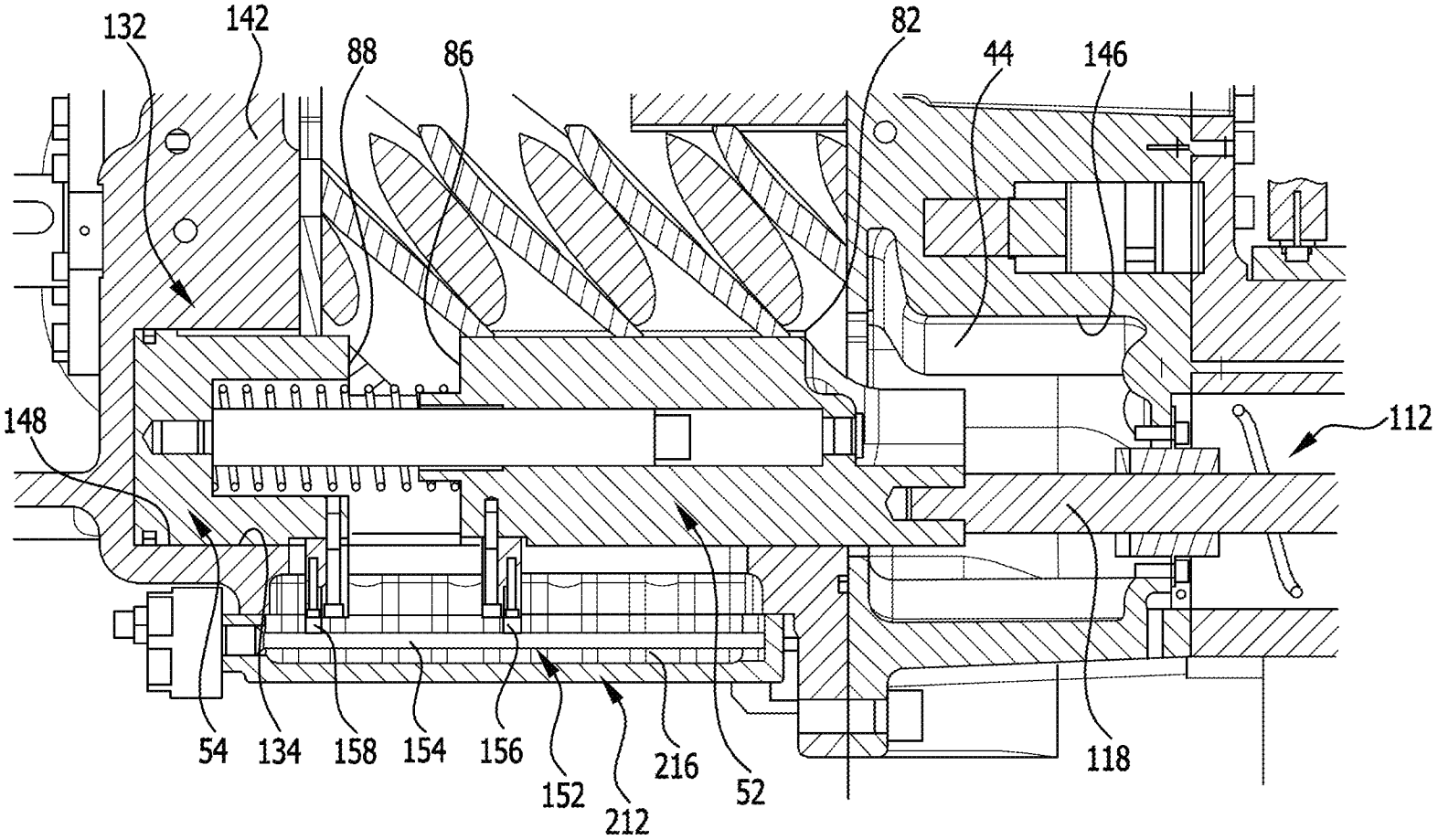
FIG. 6 shows a representation similar to FIG. 4 at about three-quarters power.

If the expander power, i.e. the actually delivered volume flow, is to vary in addition, the end faces 86 and 88 are separated by moving the control slides 52 and 54 apart into a separated disposition, as shown for example in FIG. 6. In the separated disposition, the second control slide 54 is ineffective and thus the position of the end face 86 of the first control slide 52 determines the final volume in the separated disposition.

As long as the inlet edge 82 is not in a position in which it specifies the minimum possible initial volume, however, the relation of the final volume, specified by the end face 86, to the initial volume, specified by the inlet edge 82, is not variable.

Figure 7:
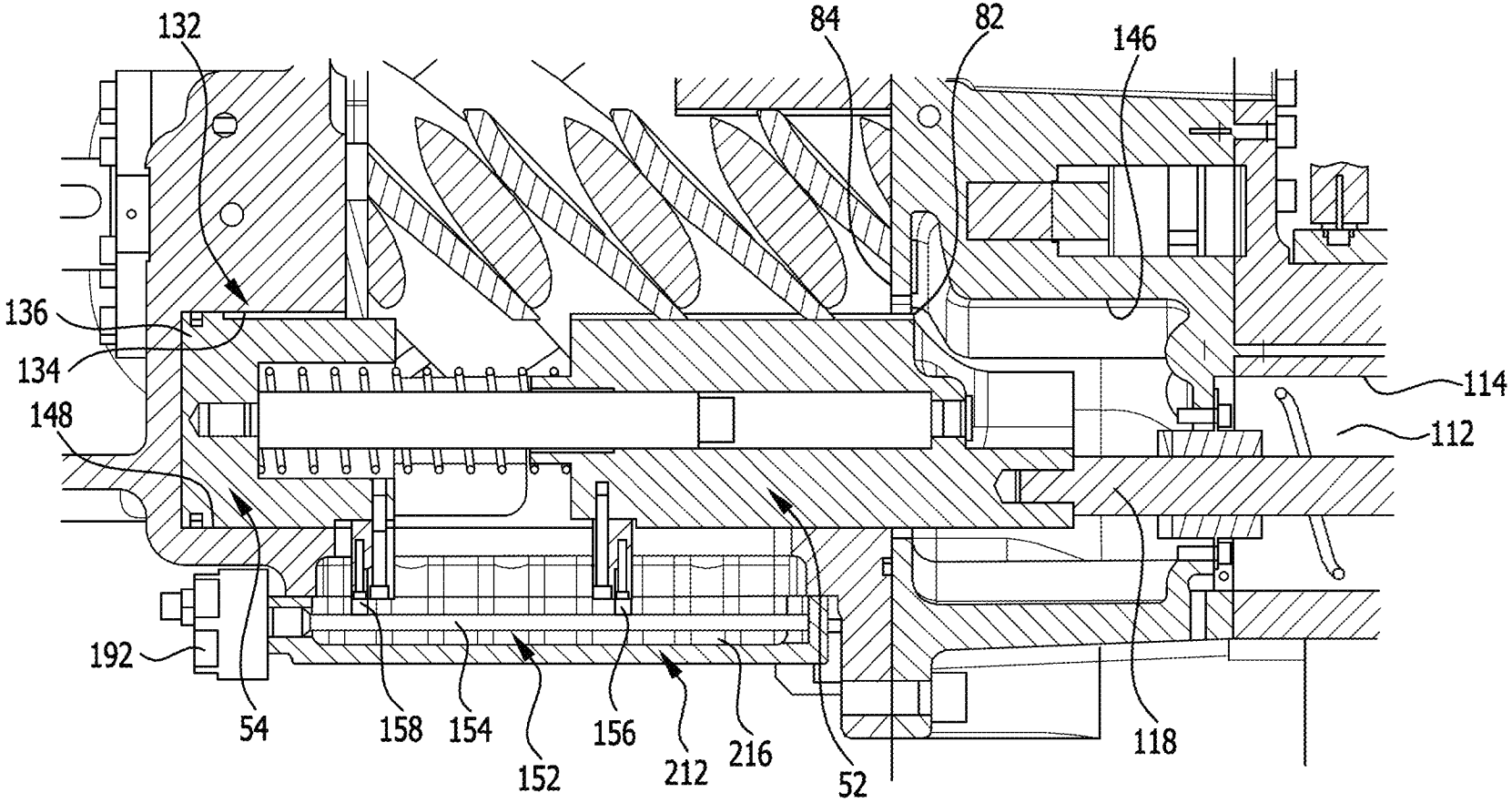
FIG. 7 shows a representation similar to FIG. 4 at approximately half power.

However, if the first control slide 52, as shown in FIG. 7, is displaced toward the high-pressure chamber 44 to such an extent that the inlet edge 82 is at the minimum spacing from the termination face 84 or is even displaced beyond it into a running-in space 146 for the first control slide 52 that is enclosed by the high-pressure chamber 44, it is possible to vary the final volume by the position of the end face 86 without changing the initial volume, since this then always remains minimal.

In particular, to eliminate the effect of the second control slide 54 in the separated disposition, the second control slide is retracted into the housing portion 142 in particular by means of the cylinder arrangement 132, the cylinder chamber 134 being dimensioned to simultaneously include a running-in space 148 for the second control slide 54, thereby providing the possibility to move the second control slide 54 far enough away from the first control slide 52 that the end face 88 no longer influences the final volume.

The second control slide 54 thus allows the final volume to be influenced in that it either abuts with its end face 88 against the end face 86 of the first control slide 52 to form the combined disposition of the control slides 52, 54 and thus maximizes the final volume, or can be moved with its own end face 88 so far away from the end face 86 of the first control slide 52 that the final volume is no longer influenced in any way by the second control slide 54, but is instead fixed by the end face 86.

For detecting the positions of the first control slide 52 and the second control slide 54, a position detection unit denoted as a whole by 152 is provided and comprises a detector element 154 extending parallel to the displacement direction 72 of the control slides 52, 54 and thus parallel to the screw rotor axes 22, 24, which detector element is capable of detecting the positions of position indicator elements 156 and 158.

Figure 9:
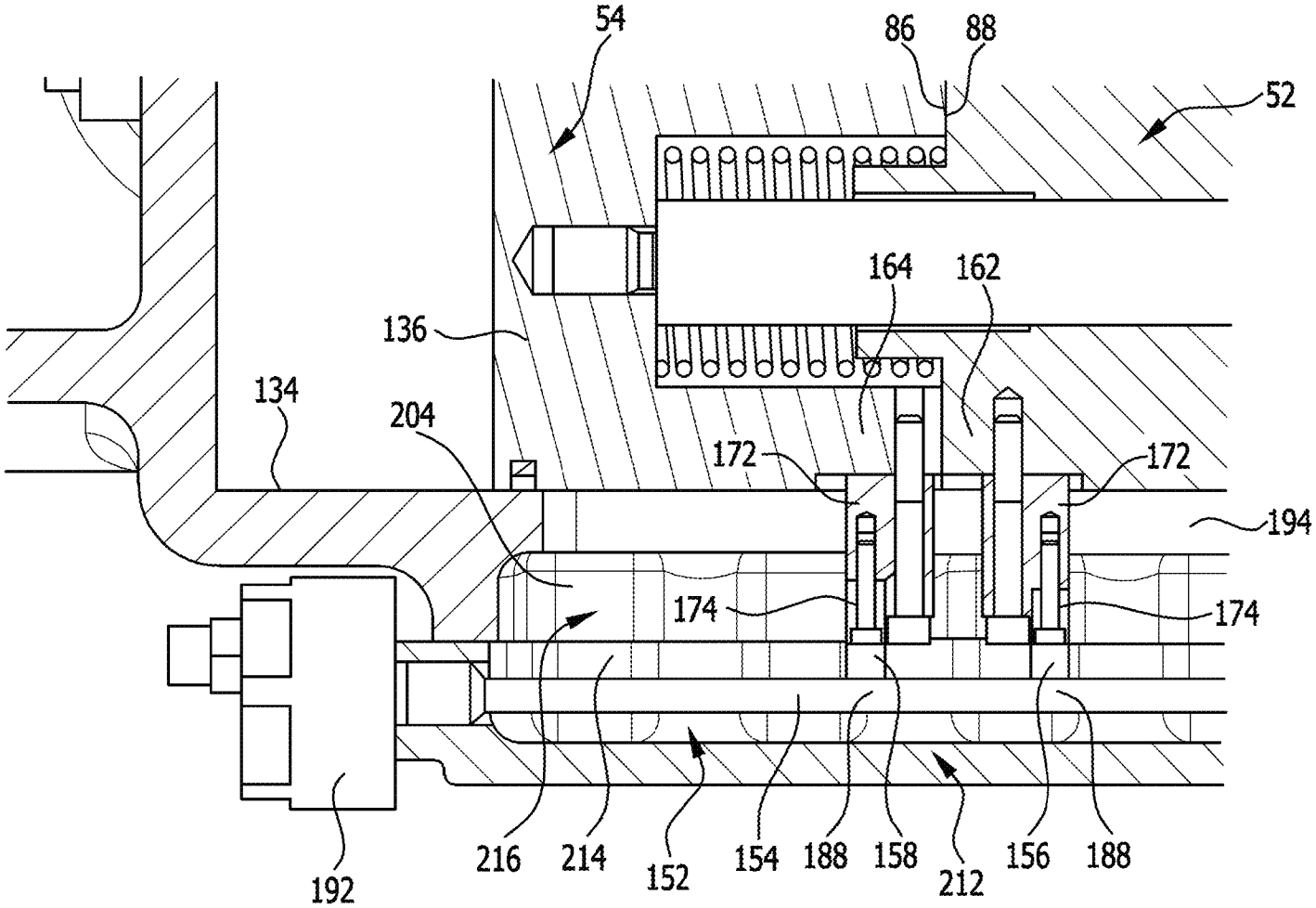
FIG. 9 shows an enlarged representation of the position detection unit and the position indicator elements in conjunction with the control slide.

The position indicator element 156 is fixedly coupled to the first control slide 52, namely to an end region 162 of the first control slide 52 adjoining the end face 86, and the position indicator element 158 is coupled to the second control slide 54, specifically to an end region 164 thereof adjoining the end face 88, as shown in particular in FIG. 9.

Figure 10:
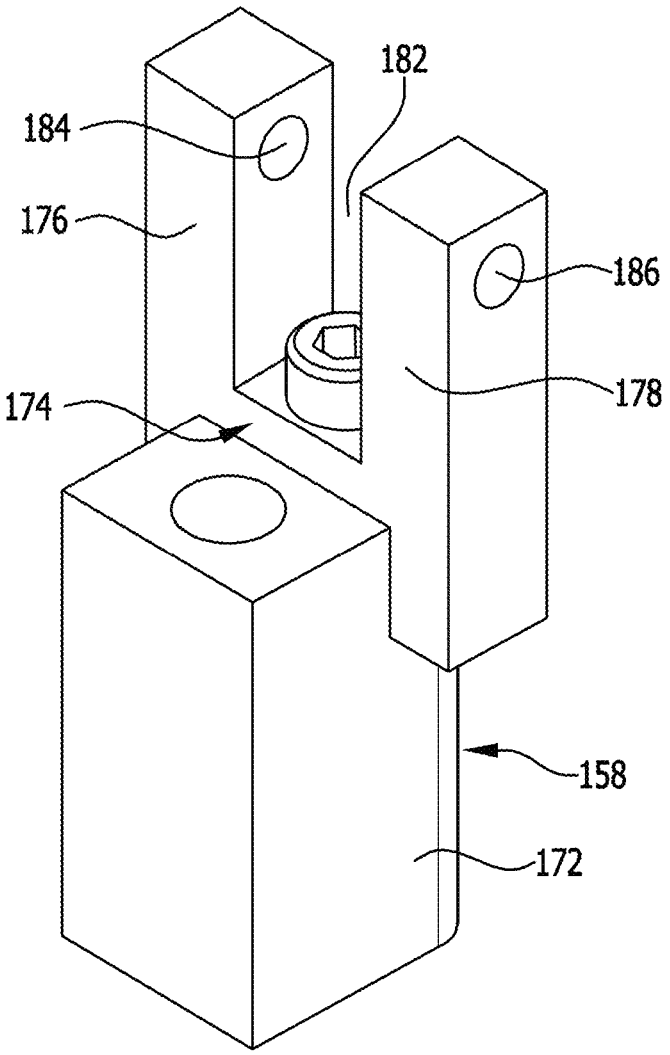
FIG. 10 shows an enlarged perspective representation of a position indicator element of the position detection unit.

As shown in FIG. 10, each of these position indicator elements 156 and 158, comprises a fork body denoted as a whole by 174, the two fork legs 176 and 178 of which define an intermediate space 182 therebetween, through which the elongate detector element 154 extends. Each of these fork bodies 174 is coupled to the corresponding control slide 52, 54 by means of a connection body 172 connected to the respective end region 162 or 164.

Preferably, the fork legs 176 and 178 carry magnets 184 and 186, respectively, the magnetic field of which passes through the detector element 154 at the location of the magnets 184, 186.

The detector element 154 is formed of a magnetostrictive material, so that the particular location 188 of the magnetic flow through the detector element 154 by the magnets 184, 186 can be determined by means of an evaluation device denoted as a whole by 192, wherein the evaluation device 192 generates, for example, sound waves in the magnetostrictive detector element 154, which sound waves experience a back reflection at the locations 188 passed through by the magnetic fields of the magnets 184, 186, so that the evaluation device 192 can determine the position of the locations 188 where the magnetic flow through the magnetostrictive detector element 154 takes place on the basis of the transit time of the reflected sound waves.

Figure 8:
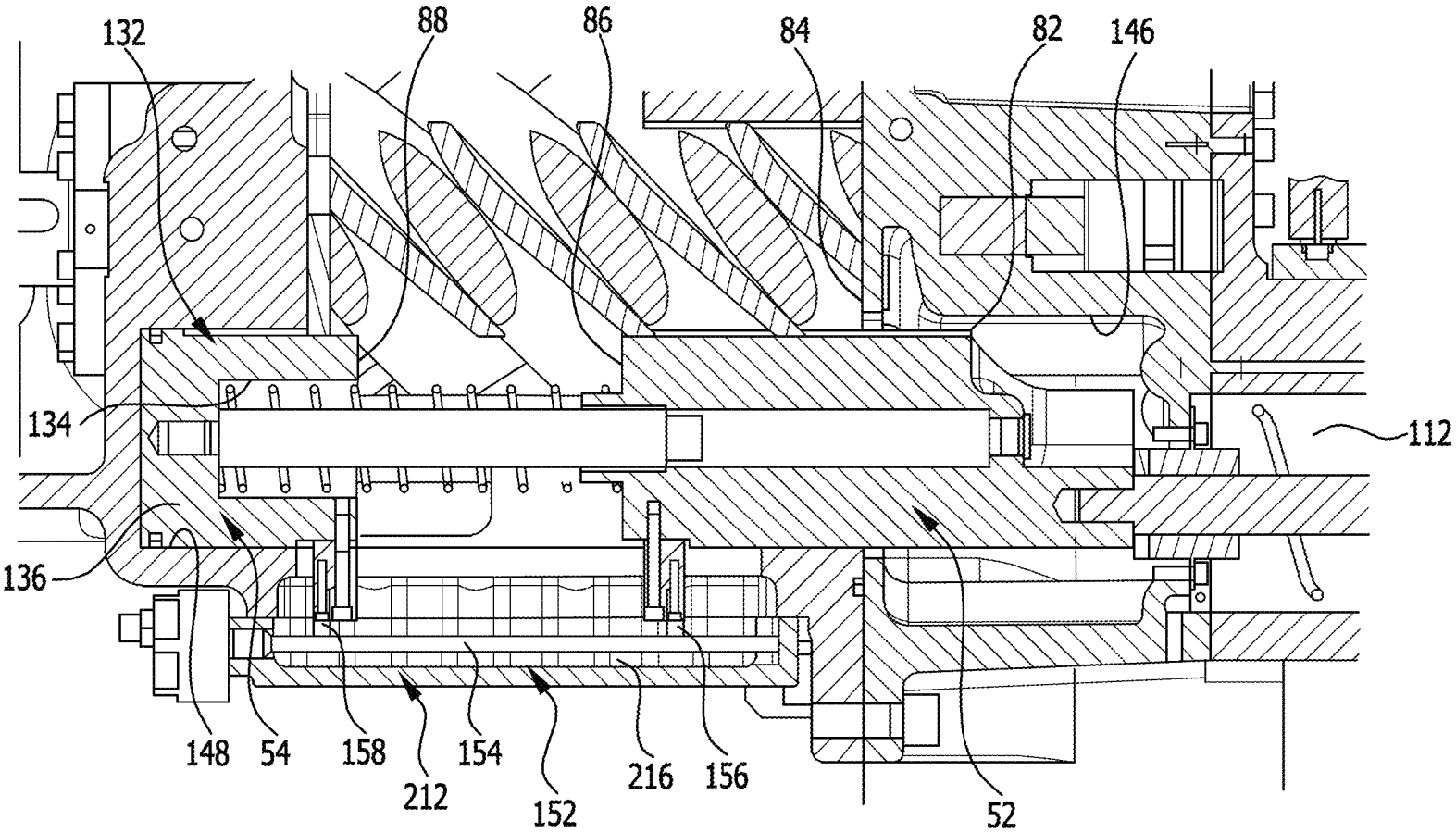
FIG. 8 shows a representation similar to FIG. 4 at about one-quarter power.

The connection bodies 172, which are held at the respective end regions 162, 164 of the control slides 52, 54, engage through an elongate, slot-shaped passage 194, which is formed in a housing wall 196 forming the slide channel 56 and has a length which, in the separated disposition, allows the second control slide 54 to be fully retracted into the retraction chamber 148 and a position of the first control slide 52 at minimum initial volume, i.e., a position corresponding to FIG. 8, and a position of the first control slide 52 at minimum volume ratio, i.e., maximum spacing of the inlet edge 82 from the pressure-side termination face 84, and further allows, in the combined disposition, a position of the second control slide 54 with the first control slide 52 at maximum volume ratio (FIG. 5) and minimum volume ratio (FIG. 4).

Each connection body 172 connected to the particular end region 162 or 164 of the corresponding control slide 52 or 54, respectively, together with the slot-shaped passage 194 forms an anti-rotation device for the control slide 52, 54 similarly to a guide by a slot nut and a groove, thus eliminating the need to provide the control slides 52, 54 with grooves which cooperate with slot nuts projecting into the slide channel 56.

The passage 194 is always held at the pressure in the low-pressure chamber 42 and thus also serves to hold the control slides 52, 54 with their guide peripheral surface 58 in contact with the slide channel 56 so that the control slides 52, 54 cannot press with the slide wall surfaces 62, 64 against the screw rotors 26, 28 as a result of high pressure forming between the slide channel 56 and the guide peripheral surface 58.

Sealing of the passage 194 against higher pressures, in particular also high pressure, is achieved here by the narrowly tolerable gap between the slide channel 56 and the guide peripheral surface 58 of the control slide 52, 54.

For receiving the fork bodies 174 and the detector element 154, a recess 204 is provided on a side of a wall 196 of a housing main body 198 opposite the slide channel 56, which recess is covered by a cover 212 which in turn has a recess 214 facing the recess 204, so that the recesses 204 and 214 supplement each other and thereby form, for example, an elongate detector channel 216 running parallel to the displacement direction 72, in which channel, on the one hand, the detector element 154 extends and in which, on the other hand, the fork bodies 174 are movable, which surround the detector element 154 on both sides with their fork legs 176, 178 and position the magnets 184, 186 in such a way that the magnetic field of said magnets flows through the detector element 154 in each case at a specific location 188.

Preferably, the cover 212 is configured such that the detector element 154 is located in the recess 214 of the cover, so that the detector element 154 together with the evaluation device 192 is held exclusively on the cover 212 and is removable therewith, while the fork bodies 174 extend in the detector channel 216, in particular both in the recess 198 and in the recess 204.

In a second simplified embodiment example of a screw expander according to the invention, as shown in FIGS. 11 to 14, only the first control slide 52' is provided.

In particular, the same components as in the first embodiment example are provided with the same reference sign, but identified by ', so that with regard to the description thereof in detail, insofar as no more detailed description is provided, reference is made to the explanations and also in particular to FIG. 1 and FIG. 3 for the first embodiment example.

In this second embodiment example, the first control slide 52' lies in the slide channel 56' and is guided therein with its guide peripheral surface 58'. Further, the first control slide 52' forms outer slide wall surfaces $\mathbf{62'}_1$ and $\mathbf{64}_1$ that directly adjoin the housing wall surfaces 66' and 68', with the slide wall surface $\mathbf{62'}_1$ being adjacent to the screw rotor 26' and the slide wall surface $\mathbf{64'}_1$ being adjacent to the screw rotor 28'.

The first control slide 52' further forms the inlet edge 82', which is arranged facing the high-pressure chamber 44' and which defines the initial volume by its spacing from the termination face 84' in a manner comparable to the first embodiment example.

Figure 12:
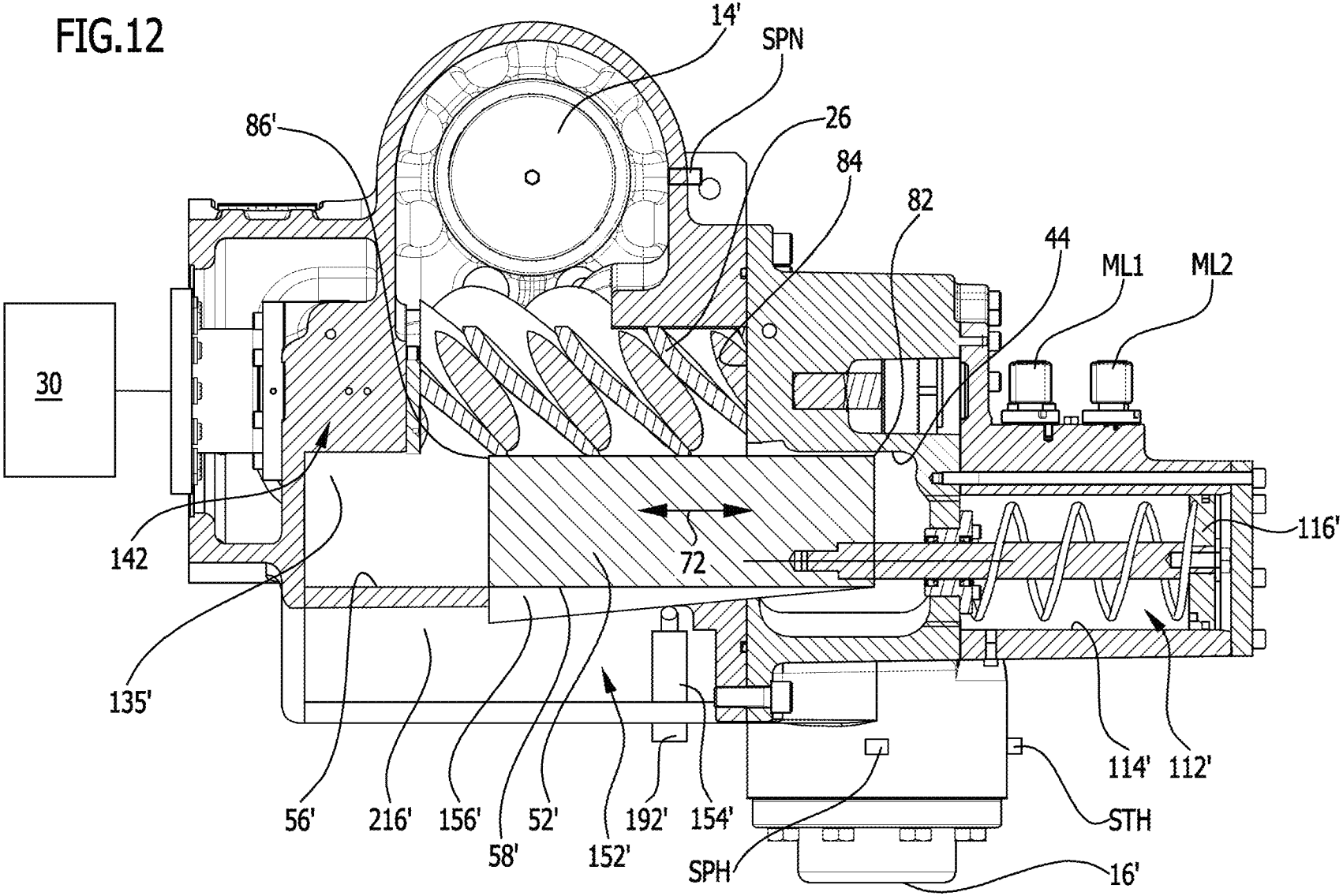
FIG. 12 shows a representation similar to FIG. 8 at reduced volume ratio and lowest power.

Furthermore, the first control slide 52' forms an outlet edge 86' which determines the final volume, the first control slide 52' having an extent parallel to the screw rotor axes 22, 24 such that, on the one hand, the maximum volume ratio $V_i$ can be set with it when the inlet edge 82' is at the shortest possible spacing from the termination face 84' and the outlet edge 86' has not yet reached the termination face 126', but is in a space 135' in the low-pressure-side housing portion 142', and, on the other hand, a reduced volume ratio $V_i$, for example with the minimum initial volume, is settable when the first control slide 52' is moved with the inlet edge 82' into the high-pressure space 44' and the outlet edge 86' specifies the final volume (FIG. 12).

Figure 13:
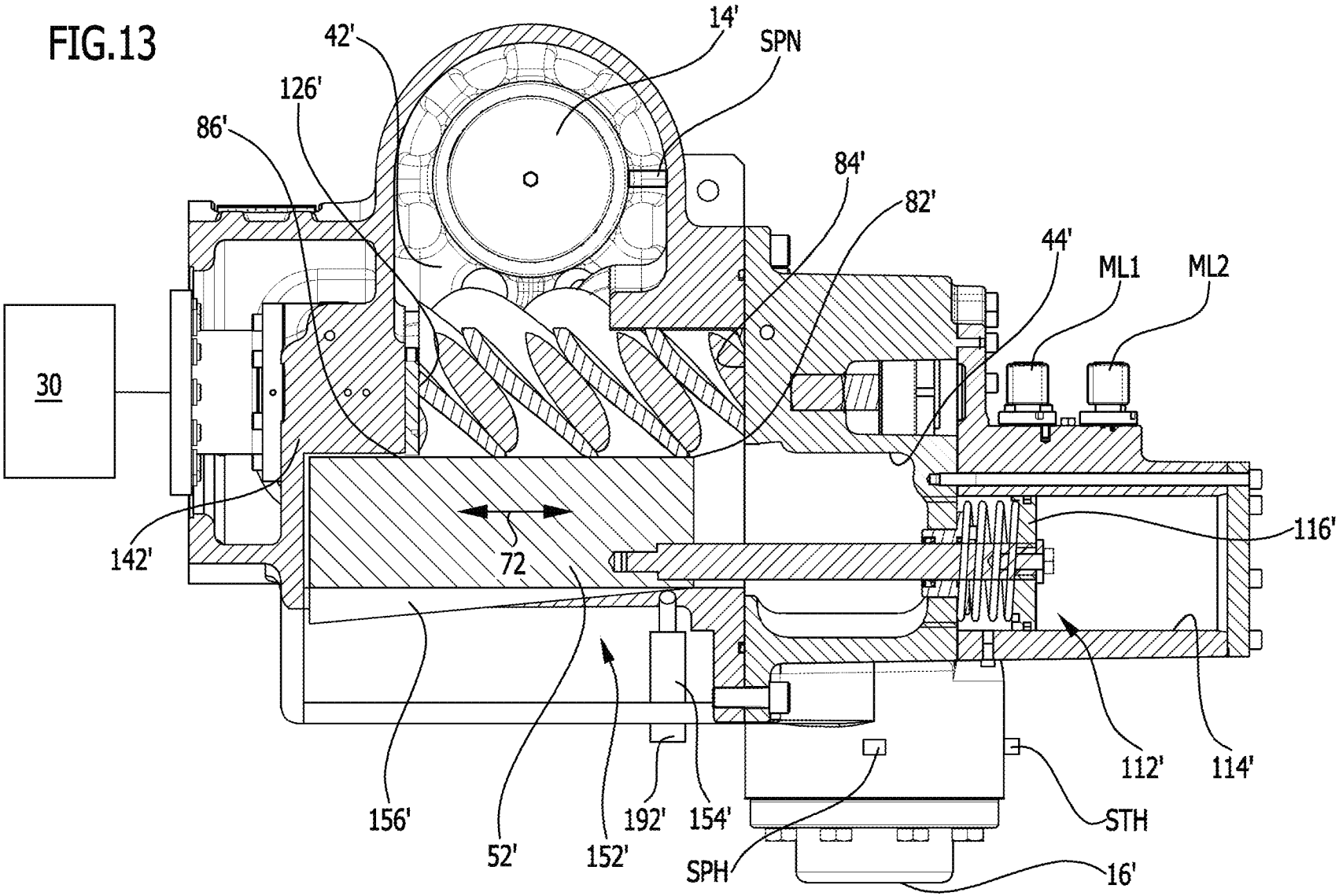
FIG. 13 shows a representation similar to FIG. 4 at the lowest volume ratio and greatest power.

However, it would also be possible to set a reduced volume ratio $V_i$ by retracting the first control slide 52' with the outlet edge 86' into the space 135' in the low-pressure-side housing portion 142' so that the initial volume for expansion is defined by the inlet edge 82' along the screw rotors 26', 28' and spaced from the termination face 84' to specify a larger initial volume (FIG. 13).

However, in this case the volume flow is greater due to the larger initial volume.

For detecting the position of the first control slide 52', a position detection unit 152' is also provided, which comprises a position indicator element 156' coupled to the first slide 52' and extending, for example as a wedge body, along the first control slide 52' and cooperating with a detector element 154', both of which are arranged in a detector channel 216 of the expander housing 12'.

Figure 14:
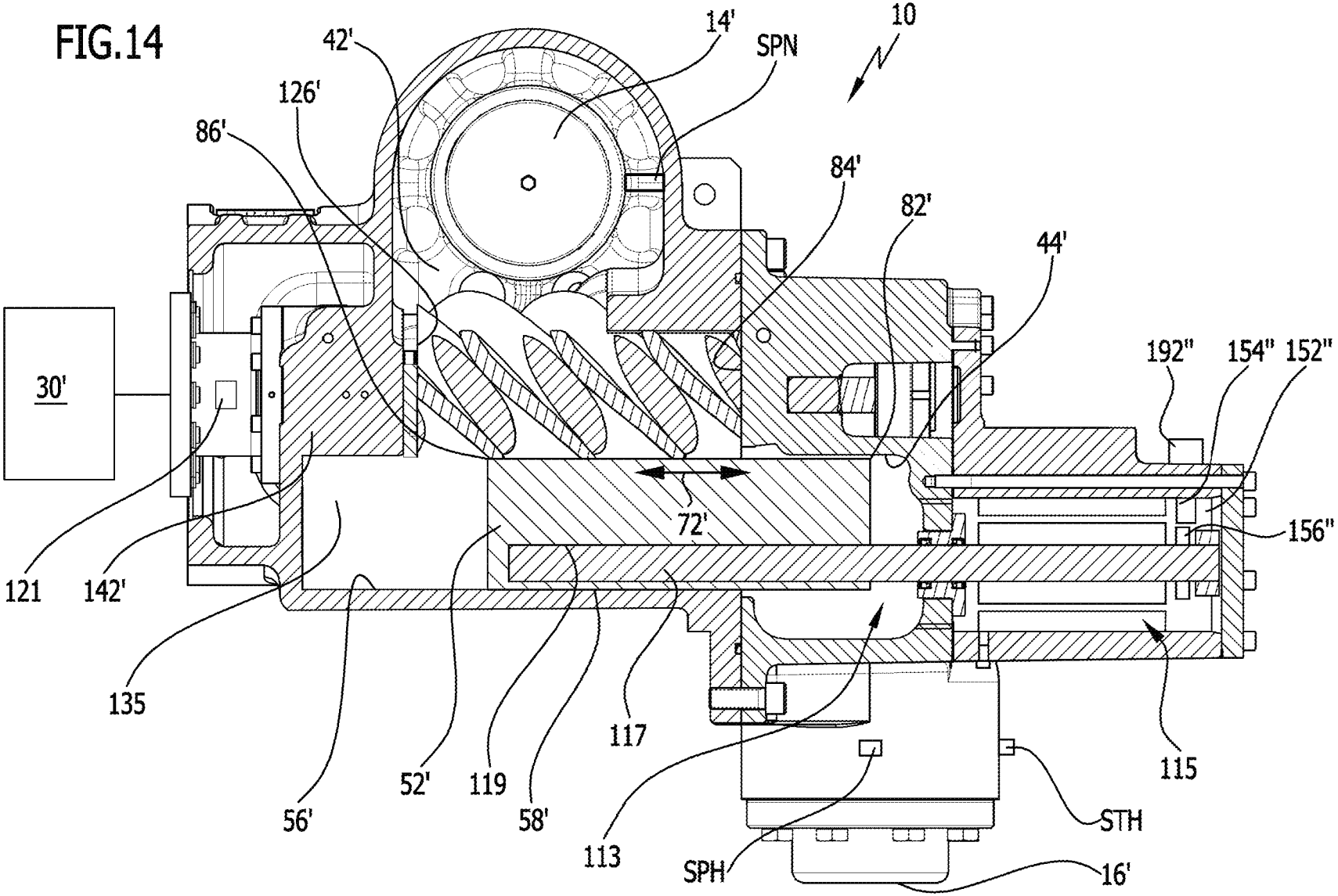
FIG. 14 shows a schematic representation of a third embodiment example of the screw expander according to the invention, similar to FIG. 11.

In a third embodiment example, shown in FIG. 14, which represents a modification of the second embodiment example, instead of the slide drive configured as a cylinder arrangement, a slide drive configured as a spindle drive 113 is provided, which has an electric drive motor 115 by means of which a spindle 117 can be driven, the spindle 117 engaging in an internal thread 119 of the slide 52', so that, when the spindle 117 is driven in rotation by the drive motor 115, the slide 52' is movable in the displacement direction 72 analogously to a spindle nut and is movable into intended positions, it being possible for the spindle 117 still to be configured in such a way that it is self-locking and thus holds the control slide 52' in the respective position.

The drive motor 115 can be powered either by the generator 30' or a separate generator 121 integrated into the expander 10, or by an external network.

Furthermore, a rotary encoder with a position indicator element 156" and a detector element 154" and an evaluation unit 192" is provided as a position detection unit 152" and detects rotary positions of the drive motor 115, on the basis of which a conclusion is drawn about the position of the control slide 52' specified by the spindle 117.

With regard to the further configuration and features of the third embodiment example, reference is made in full to the explanations for the first and second embodiment example.

In all other respects, those elements of the third embodiment example are provided with the same reference signs as the first and second embodiment examples, and therefore reference is made to said embodiment examples.

In the first and second and third embodiment examples, for moving the control slides 52, 52' and 54 into the positions intended for them, as shown in FIG. 2, a control system 218 is provided, which, by being connected to the position detection unit 152, 152', 152", is able to determine the actual positions of the control slides 52, 52', 54.

As shown in FIGS. 1 and 2, the control system 218 can be used to control the respective slide drives, for example the cylinder arrangements 112, 112' and 132 or the spindle drive 113, in order to position the respective control slides 52, 52', 54.

For this purpose, for example, solenoid valves ML1 and ML2 are actuable to control the oil supply to the cylinder arrangement 112, 112' for the first control slide 52, 52', and solenoid valves MV1 and MV2 are actuable to control the oil supply to the cylinder arrangement 132 for the second control slide 54, or the drive motor 115 are actuable.

In all embodiment examples, the control system 218 detects the high pressure PH with a pressure sensor SPH (FIG. 2, FIG. 11, FIG. 14), the low pressure PN resulting after expansion with a pressure sensor SPN (FIG. 2, FIG. 11 and FIG. 14), and controls, for example, the positions of the first control slide 52 and the second control slide 54 in the first embodiment example or only the position of the first control slide 52' in the second embodiment example based on a detected pressure ratio PV=PH/PN by comparison with at least a first limit value $G_1$.

If the pressure ratio PV is greater than the limit value $G_1$, a maximum volume ratio $V_i$ is set and if the pressure ratio PV is less than the limit value $G_1$, a reduced volume ratio is set.

In the first embodiment example, there is a maximum volume ratio with a position of the first and second control slides 52, 54 according to FIG. 5 and there is a reduced volume ratio with a position of the first and second control slides 52, 54 according to FIG. 4 at maximum volume flow or, for example, according to FIGS. 6, 7 at reduced volume flow, or 8 at minimum volume flow.

Figure 11:
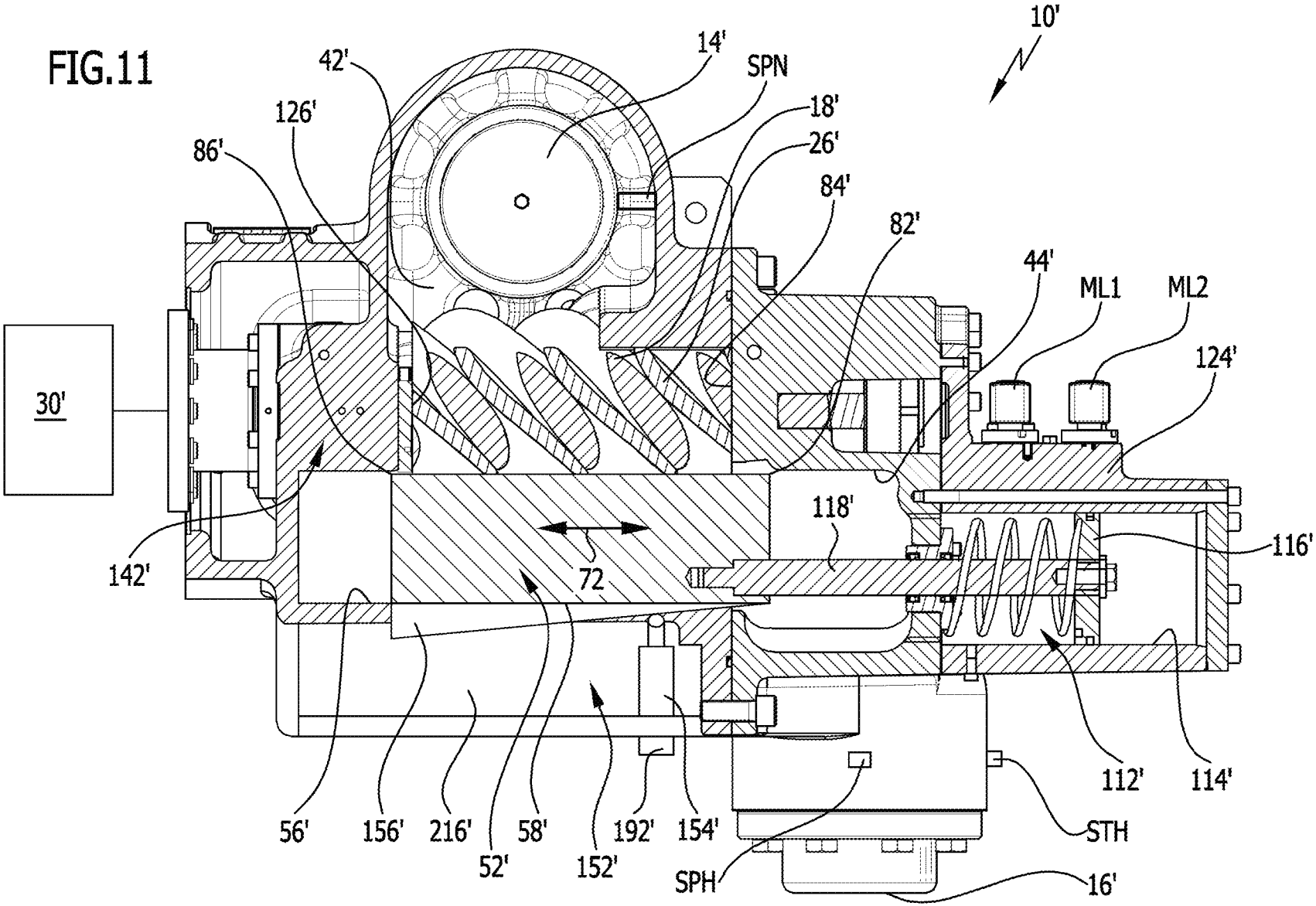
FIG. 11 shows a schematic representation of the second embodiment example of the screw expander according to the invention with only one control slide similar to FIG. 5 at the highest volume ratio and highest power.

In the second and third embodiment examples, there is a maximum volume ratio $V_i$ with a position of the first control slide 52' according to FIG. 11 or FIG. 14 or there is a reduced volume ratio with a position according to FIG. 12 or 13 with the same volume flow.

Since several slide positions are possible for reduced volume ratios, it is also possible to switch between the slide positions for reduced volume ratios, for example by defining further limit values $G_w$, wherein likewise when such a further limit value $G_w$ is exceeded or undershot, a transition to a larger reduced volume ratio $V_i$ or to a smaller reduced volume ratio, respectively, is effected by the control system 218.

The control system 218 can be further optimized with regard to its function if it detects the positions of the control slides 52, 54 or 52' with the described position detection unit 152, 152', 152" and controls the respective slide drive, for example by clocked operation of the solenoid valves ML1 and ML2 and, if necessary, MV1 and MV2, controls the cylinder arrangements 112, 112' and, if necessary, 132, or controls suitable operation of the drive motor 115, in order, for example, to approach predefined positions of the control slides 52, 52' and 54 for setting specified volume ratios $V_i$.

In particular, it is also possible to position the control slides 52, 52', 54 with the control system 218 in a position-controlled manner, that is, for example, to precisely approach and hold the positions of these control slides 52, 52', 54 determined by an expander control program and possible within the scope of the displaceability of the control slide.

Such an expander control program runs, for example, on a higher-level expander control system.

In the embodiment examples shown, this expander control program is integrated in particular into the control system 218, in particular with the use limits of the screw expander 10 and the parameters of the gaseous working medium, i.e. in particular of the refrigerant, being known, and detects, for example, the low pressure by means of the pressure sensor SPN (FIGS. 2, 11, 14), the high pressure by means of the pressure sensor SPH (FIG. 2, 11, 14), and the temperature of the working medium on the high-pressure side by means of a temperature sensor STH (FIG. 2) as well as the temperature of the working medium on the low-pressure side by means of a temperature sensor STN.

In addition, in particular, the control system 218 can also still detect operating parameters of an electrical generator 30 with respect to speed, power consumption, voltage, and temperature.

Further, the control system 218 can also in particular sense a lubricant pressure, a lubricant flow, a lubricant level, and a lubricant temperature.

Further, the required expander power, for example for an expansion circuit in which the screw expander 10 operates, is also specified in particular to the control system 218 by an external signal.

From some selected ones of these values, in particular from the information about the working medium, for example about the refrigerant, about pressure and temperature on the high-pressure side and the low-pressure side as well as about the speed of the screw rotors 26, 28, or from further of these above-mentioned values, an optimal position of the control slides 52, 52', 54 can be determined by the control system 218 with the expander control program for the particular operating state and can be set in a position-controlled manner.

Figure 15:
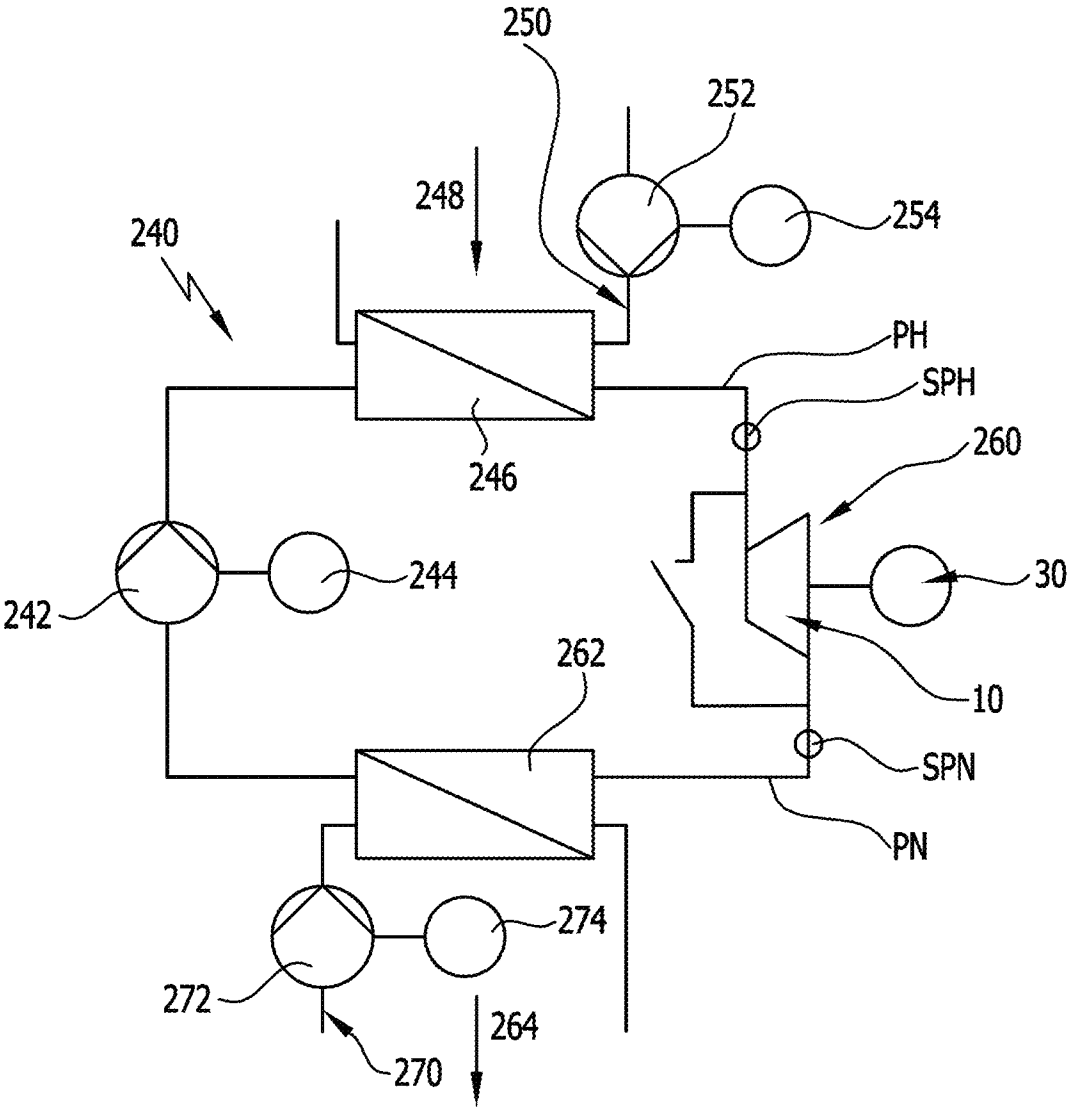
FIG. 15 shows a schematic representation of a plant for recovering electrical energy from heat with a cyclic process with a screw expander according to the invention.

A system for recovering electrical energy from heat, in particular for recovering electrical energy from waste heat, shown in FIG. 14 comprises a cyclic process, shown in FIG. 15, in particular a cyclic process operating with a Rankine cycle, in which a working medium guided in a circuit 240 is compressed starting from the condensed state by a compressor 242 driven by a motor 244.

In a subsequent heat exchanger 246, the working fluid is vaporized by supplying heat from a heat flow 248.

For example, heat is supplied by the heat flow 248 by means of a hot water circuit 250 which flows through the heat exchanger 246 and in which a hot water pump 252 is arranged for circulating the hot water in the hot water circuit 250, which pump is driven in turn by a motor 254.

The working medium evaporated by the supply of the heat flow 248 in the heat exchanger 246 is supplied to an expansion unit 260 which is arranged downstream of the heat exchanger 246 in the circuit 240 and which comprises, in particular, one of the screw expanders 10 described above, which drives a generator 30 to generate electricity.

After flowing through the screw expander 10, the working medium in the circuit 250 is supplied to a heat exchanger 262 in which the working medium condenses, with a heat flow 264 being removed by the heat exchanger 262.

In particular, a cold water circuit 270 is provided for this purpose, which also passes through the heat exchanger 262, a cold water pump 272 being arranged in the cold water circuit 270 and being driven by a motor 274.

In particular, isentropic, preferably ideal isentropic, compression of a liquid-saturated condensate of the working medium generated by the heat exchanger 262 takes place by the compressor 242, and substantially isobaric evaporation of the supercooled system takes place in the heat exchanger 246 until the vapor-saturated state is reached, in which the working medium is then fed to an expansion unit 260, with mechanical work being generated in the screw expander 10 by expansion, as a result of which the generator 30 is driven.

Lastly, in the heat exchanger 262, an isobaric, in particular a complete isobaric, condensation of the working medium takes place by removal of the heat flow 264, so that then, again, a liquid-saturated condensate can be supplied to the compressor 242.

In particular, organic working media, such as R245fa, R1224yd(z), R1336mzz(Z), R1336mzz(E), R1233zd, R1234ze, R1234yf, R134a, R513a, R245fa and mixtures thereof or similar media are used as working medium.

Preferably, such a cyclic process serves to utilize industrial waste heat, for example in the range between 85° C. and 700° C., such that this waste heat can be optimally converted into electrical energy by the above-described cyclic process.

Since the supply of the heat flow 248 and also the removal of the heat flow 264 change during the cyclic process, the high pressure PH and low pressure PN arising at the screw expander 10, which pressures are detected by the sensors SPH and SPN, also change, and thus so too does the pressure ratio PV, so that it is advantageous to adapt the screw expander 10 to changing pressure ratios in order to prevent over-expansion on the one hand and under-expansion on the other hand, each of which results in the screw expander 10 with the generator 30 being unable to convert the separate energy provided in the circuit 240 into electrical energy.

This adaptation to different pressure conditions is allowed by the screw expander 10 described above with the different positions of the control slides 52, 52', 54, which can be realized by the different described possibilities of the control system 218 of said screw expander.

Figure 16:
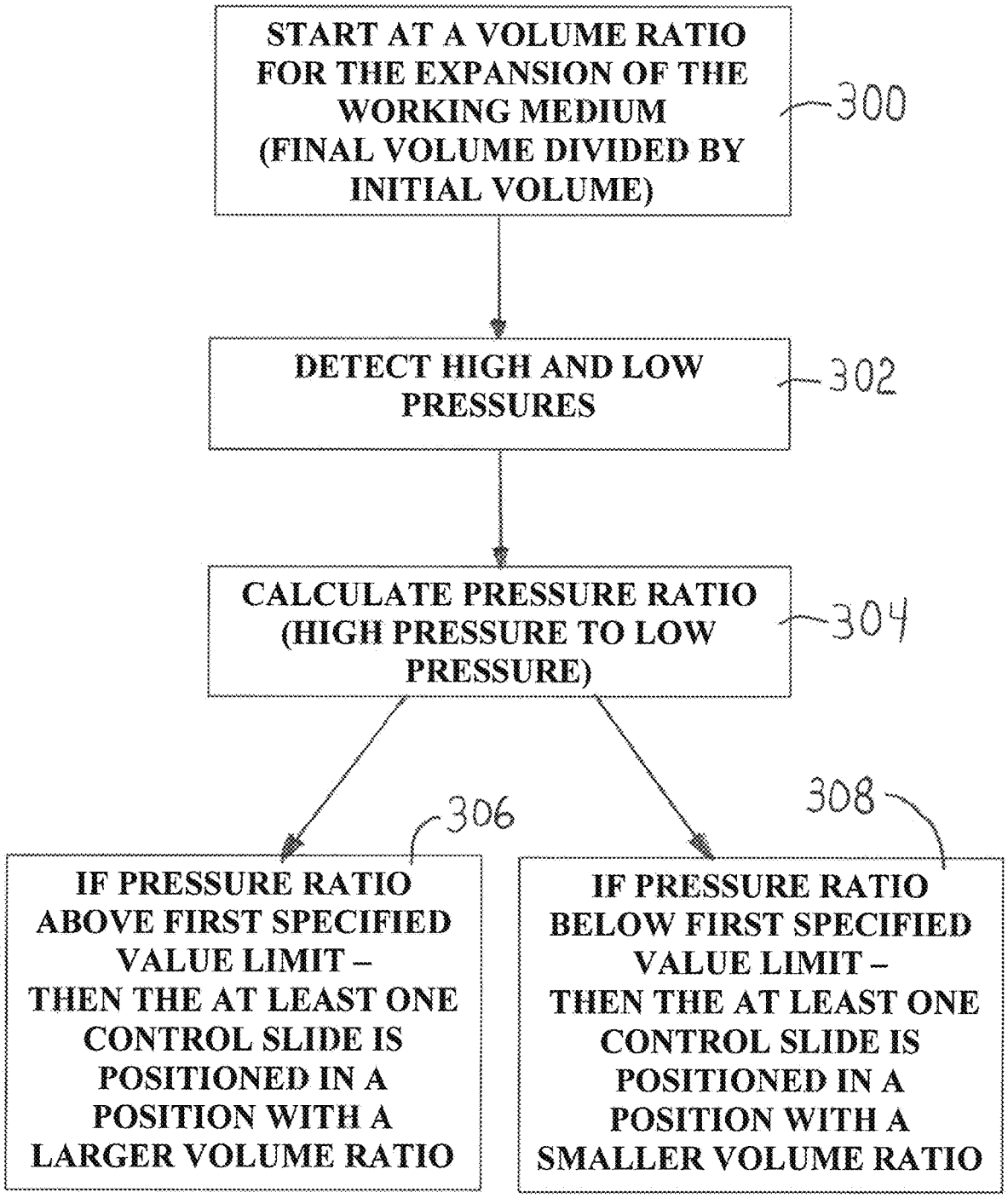
FIG. 16 is a flow chart of an embodiment of controls that may be implemented in the above figures.

In the flow chart of FIG. 16, an example of a control configuration for the compressor embodiments of FIGS. 1-15 is provided according to an embodiment in which configuration starts at a volume ratio suitable for the for the expansion of the working medium at 300. In such a configuration, the high and low pressures are detected at 302 (For example, as previously discussed, the control system 218 detects the high pressure PH with a pressure sensor SPH (FIG. 2, FIG. 11, FIG. 14), and the low pressure PN resulting after expansion with a pressure sensor SPN (FIG. 2, FIG. 11 and FIG. 14)). Using detected pressures, a pressure ratio is calculated at 304 (i.e., high pressure to low pressure). With this, if the pressure ratio is above a first specified value limit, then the at least one control slide (52, 54 or 52) is positioned in a position with a larger volume ratio at 306; and if the pressure ratio is below the first specified value limit, then the at least one control slide (52, 54 or 52) is positioned in a position with a smaller volume ratio at 308.

The invention claimed is:

1. A screw expander comprising an expander housing with a screw rotor chamber arranged therein, two screw rotors which are arranged in the screw rotor chamber and are each mounted in the expander housing so as to be rotatable about a screw rotor axis, which screw rotors intermesh with their screw contours and each cooperate with wall surfaces adjacent to the screw contours and partially surrounding the screw contours, in order to receive working medium supplied by means of a high-pressure chamber arranged in the expander housing adjacent to the screw rotors and to discharge it in the region of a low-pressure chamber arranged in the expander housing, the gaseous working medium being enclosed with an initial volume at high pressure in expansion chambers formed between the screw contours and wall surfaces adjacent thereto and being expanded to a final volume at low pressure, and a generator driven by the screw rotors, the screw expander has at least one control slide arranged in a slide channel of the expander housing and adjacent to both screw rotors with slide wall surfaces, which the at least one control slide is movable in a displacement direction parallel to the screw rotor axes and is thereby configured to influence the final volume and/or the initial volume, and in that a slide drive is provided for moving the at least one control slide into different slide positions, said at least one control slide facing the high pressure chamber which is arranged on a high pressure side of the at least one control slide, said at least one control slide forming an inlet edge facing the high pressure chamber and defining an inlet volume of the expansion chambers wherein the inlet edge can be displaced relative to a high-pressure side termination face of the screw rotor chamber for determining the initial volume of the expansion chambers formed and thus a volume ratio, and wherein the inlet edge can be at a minimum spacing from the high-pressure side termination face and can be displaced beyond the high-pressure side termination face into a run-in space for the control slide that is enclosed in the high pressure chamber in order to vary the final volume by a position of an end face of said control slide opposite to said inlet edge without changing the initial volume which then always remains minimal, and wherein a control system is provided which controls the slide drive for the at least one control slide to set a volume ratio for the expansion of the working medium, said volume ratio being formed from final volume divided by initial volume, wherein the control system detects the high pressure and the low pressure by means of respective sensors arranged one on the high-pressure side and one on the low-pressure side and determines a pressure ratio of high pressure to low pressure from this, and wherein the control system positions the at least one control slide by actuating the slide drive according to whether the pressure ratio of high pressure to low pressure exceeds and/or undershoots at least one specified limit value.

2. A screw expander according to claim 1, wherein the screw expander has two control slides, wherein a first control slide is configured to influence the initial volume and a second control slide is configured to influence the final volume.

3. A screw expander according to claim 2, wherein the first control slide and the second control slide are arranged one behind the other in the displacement direction thereof.

4. A screw expander according to claim 3, wherein the first control slide and the second control slide have an identical outer contour.

5. A screw expander according to claim 3, wherein the first control slide and the second control slide are positionable in a combined disposition directly adjoining one another and are movable together in the displacement direction.

6. A screw expander according to claim 3, wherein the first and second control slides are positionable in a separated disposition at a spacing from each other, forming an intermediate space.

7. A screw expander according to claim 2, wherein the first control slide is rigidly connected to a piston of a cylinder arrangement forming the first slide drive for moving the first control slide.

8. A screw expander according to claim 2, wherein the second control slide is rigidly coupled to a piston of a cylinder arrangement forming the second slide drive for movement of the second control slide.

9. A screw expander according to claim 1, wherein the control system moves the at least one control slide into a position with a smaller volume ratio of the final volume to the initial volume when the at least one specified limit value is undershot.

10. A screw expander according to claim 1, wherein the control system moves the at least one control slide into a position with a larger volume ratio of the final volume to the initial volume when the at least one specified limit value is exceeded.

11. A screw expander according to claim 1, wherein the at least one specified limit value comprises a plurality of limit values for the pressure ratio, the control system positions the at least one control slide in accordance with exceeding or undershooting a the plurality of limit values for the pressure ratio.

12. A screw expander according to claim 1, wherein the control system moves the at least one control slide into slide positions corresponding to predefined volume ratios.

13. A screw expander according to claim 1, wherein the control system positions the at least one control slide in a position-controlled manner.

14. A screw expander according to claim 1, wherein the control system determines the positions of the at least one control slide taking into account at least one or more of the parameters, such as pressure level at low pressure, pressure level at high pressure, temperature of the gaseous working medium at high pressure and low pressure, speed of the screw rotors, power consumption of a generator, parameters of the gaseous working medium, and use limit values of the screw expander.

15. A screw expander according to claim 1, wherein a position detection unit is provided for the at least one control slide.

16. A screw expander according to claim 15, wherein the position detection unit has a position indicator element coupled to the position of the at least one control slide, in that the at least one position indicator element cooperates with a detector element, and in that the detector element is coupled to an evaluation unit which detects the positions of the position indicator element.

17. A screw expander according to claim 15, wherein the at least one position indicator element is movable parallel to the displacement direction of the at least one control slide together therewith.

18. A screw expander according to claim 15, wherein the at least one control slide comprises two control slides, and wherein a position detection unit for the two control slides is provided, which comprises a first position indicator element coupled to the first control slide and a second position indicator element coupled to the second control slide, and in that both position indicator elements cooperate with a common detector element.

19. A screw expander according to claim 15, wherein the detector element extends parallel to the displacement direction of the first and second control slides and along which the first position indicator element and the second position indicator element are movable when the control slides are moved.

20. A screw expander according to claim 15, wherein the detector element extends parallel to the displacement direction of the at least one control slide along which the position indicator element is movable.

21. A screw expander according to claim 15, wherein the position detection unit is arranged in a detector channel running within the expander housing parallel to the displacement direction.

22. A screw expander according to claim 15, wherein the position detection unit comprises a position indicator element arranged in a detector channel.

23. A screw expander according to claim 1, wherein the respective position indicator element cooperates with the detector element in a contactless manner.

24. A screw expander according to claim 1, wherein the at least one control slide is driven by means of a spindle drive.

25. A screw expander according to claim 24, wherein the spindle drive is driven by an electric drive motor.

26. A plant for recovering electrical energy from heat, comprising a cyclic process in which a working medium guided in a circuit is compressed starting from the condensed state, evaporated by the supply of heat, expanded in an expansion unit and subsequently condensed by the removal of heat, wherein the expansion unit has at least one screw expander according to claim 1 for the expansion of the working medium.

27. The screw expander of claim 1, wherein the control system controls the at least one control slide with the inlet edge positioned at the minimum spacing thereby ensuring the volume ratio is variable, in which the inlet edge is displaced relative to the high-pressure side termination face of the screw rotor chamber, thereby determining the initial volume of the expansion chambers formed and thus the volume ratio, and the inlet edge is at a minimum spacing from the high-pressure side termination face and is displaced beyond the high-pressure side termination face into the run-in space in order to vary the final volume without changing the initial volume.

28. The screw expander of claim 27, wherein if the inlet edge were not in the minimum spacing specifying the minimum possible initial volume, the relation of the final volume specified by the end face opposite the inlet edge to the initial volume specified by the inlet edge would not be variable.

* * * * *